US007096645B2

(12) United States Patent
Tashiro et al.

(10) Patent No.: US 7,096,645 B2
(45) Date of Patent: Aug. 29, 2006

(54) METHOD OF AND APPARATUS FOR PACKAGING ROLLED ARTICLE

(75) Inventors: Katsumi Tashiro, Minamiashigara (JP); Masamichi Hara, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/781,292

(22) Filed: Feb. 19, 2004

(65) Prior Publication Data

US 2004/0163985 A1 Aug. 26, 2004

(30) Foreign Application Priority Data

Feb. 20, 2003 (JP) ..... 2003-043190

(51) Int. Cl.
*B65B 11/04* (2006.01)
*B65B 25/24* (2006.01)

(52) U.S. Cl. ..... 53/409; 53/410

(58) Field of Classification Search ..... 53/118, 53/204, 214, 409, 410, 372.9, 587
See application file for complete search history.

(56) References Cited

U.S. PATENT DOCUMENTS 3,342,014 A * 9/1967 Prager ..... 53/214
3,633,335 A * 1/1972 Johnson ..... 53/372.9
3,828,523 A * 8/1974 Brenner et al. ..... 53/372.9
4,485,612 A * 12/1984 Piesen et al. ..... 53/214
4,524,562 A * 6/1985 Yagi et al. ..... 53/409
4,534,151 A * 8/1985 Schneck et al. ..... 53/415
5,267,704 A 12/1993 Kitamura et al.
5,337,536 A * 8/1994 Takahashi et al. ..... 53/204
5,533,321 A * 7/1996 Hooper et al. ..... 53/465
6,095,330 A 8/2000 Essert et al.
6,481,904 B1 11/2002 Fukugawa et al.
6,857,586 B1 * 2/2005 Kadota et al. ..... 242/160.3
2002/0059782 A1 5/2002 Kadota et al.
2002/0148922 A1 10/2002 Kadota et al.

FOREIGN PATENT DOCUMENTS

EP 1 011 021 A1 6/2000
EP 1113319 * 7/2001
EP 1 132 769 A2 9/2001
JP 10-129613 A 5/1998
JP 2003-310834 A 11/2000
JP 2001-249431 A 9/2001
JP 2002-68115 A 3/2002
JP 2003-026113 A 1/2003

* cited by examiner

*Primary Examiner*—John Sipos
(74) *Attorney, Agent, or Firm*—Sughrue Mion, PLLC

(57) ABSTRACT

A packaging apparatus has a packaging sheet feed mechanism for gripping a side edge of a light-shielding leader and feeding the light-shielding leader to a winding position to position it in the winding position, a rotating and supporting mechanism for positioning a photosensitive roll with respect to the light-shielding leader in the winding position, and rotating the photosensitive roll, an attaching mechanism for attaching the light-shielding leader to an end of the photosensitive roll, a light-shielding leader holding mechanism for gripping a winding end of the light-shielding member and moving the light-shielding leader toward the photosensitive roll when the photosensitive roll is rotated, a pressing mechanism for pressing the outer circumferential edges of light-shielding members against respective opposite ends of the photosensitive roll, and a skirt processing mechanism for processing a light-shielding shrink film so as to cover the outer circumferential edges of light-shielding members.

11 Claims, 21 Drawing Sheets

METHOD OF AND APPARATUS FOR PACKAGING ROLLED ARTICLE

BACKGROUND OF THE INVENTION

1. Field of the Invention

The present invention relates to a method of and an apparatus for packaging a rolled article by winding a packaging sheet with skirts around the rolled article which has opposite end faces to be covered with respective end packaging members, respectively.

2. Description of the Related Art

Films for use in the platemaking field, for example, are usually supplied as light-shielded photosensitive rolls.

A light-shielded photosensitive roll is manufactured as follows: First, an elongate photosensitive sheet is wound around a core, producing a photosensitive roll (rolled article). Then, disk-shaped light-shielding members (end packaging members) are attached to the respective opposite end faces of the photosensitive roll, and a light-shielding leader (packaging sheet) including a light-shielding sheet and light-shielding shrink films (skirts) is joined to the leading end of the photosensitive sheet of the photosensitive roll. Then, the light-shielding leader is wound around the photosensitive roll, and the light-shielding shrink films are heated and thermally fused while they are being folded over the light-shielding members. Thereafter, the trailing end of the light-shielding leader is fixed in position by an end fixing tape. In this manner, the light-shielded photosensitive roll is produced. For more details, see Japanese laid-open patent publication No. 2001-249431, for example.

The applicant of the present application has proposed a method of and an apparatus for packaging a rolled article to manufacture a light-shielded photosensitive roll of the type described above. One method and apparatus for packaging a rolled article is, disclosed in Japanese laid-open patent publication No. 2003-26113. The disclosed method and apparatus make it possible to wind a packaging sheet neatly and efficiently around a rolled article according to a simple process with a simple arrangement.

SUMMARY OF THE INVENTION

It is a general object of the present invention to provide a method of and an apparatus for packaging a rolled article to wind a packaging sheet neatly and reliably around the rolled article.

A major object of the present invention is to provide a method of and an apparatus for packaging a rolled article to wind a packaging sheet accurately around the rolled article while keeping the rolled article and the packaging sheet in good positional relationship to each other.

Another object of the present invention is to provide a method of and an apparatus for packaging a rolled article while preventing end packaging members attached to the opposite end faces of the rolled article from floating off or being warped.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
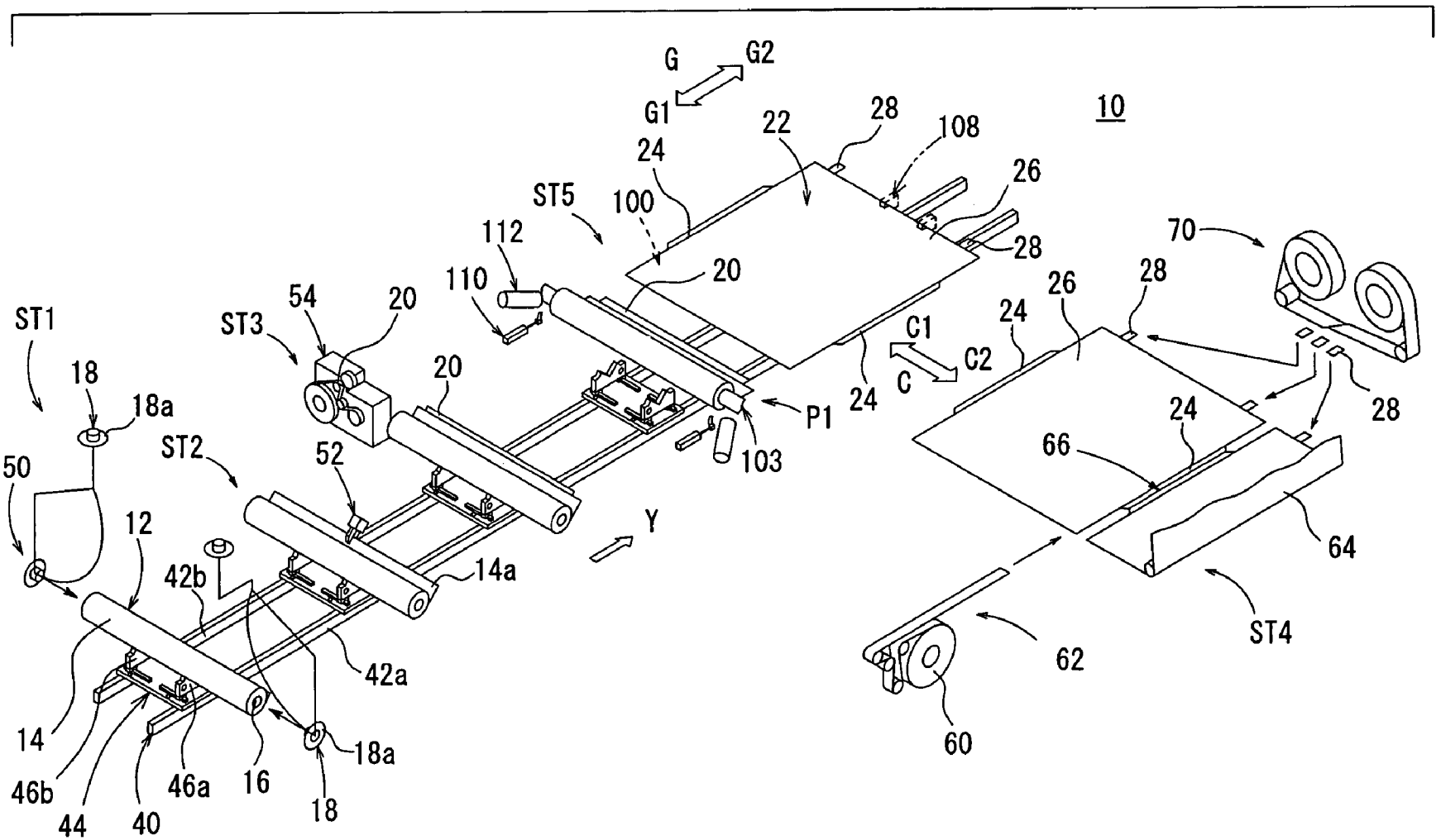
FIG. 1 is a schematic perspective view of a packaging system for carrying out a method of packaging a rolled article according to the present invention.

FIG. 1 shows in perspective a packaging system 10 for carrying out a method of packaging a rolled article according to the present invention.

As shown in FIG. 1, the packaging system 10 has a light-shielding member inserting station ST1 for assembling disk-shaped light-shielding members 18, each having an outer circumferential edge portion 18*a*, on respective opposite ends of a photosensitive roll (rolled article) 12 which comprises an elongate photosensitive sheet 14 wound around a core 16, an end drawing station ST2 for drawing an end 14*a* of the photosensitive sheet 14 to a prescribed length, an attaching station ST3 for attaching a joint tape 20 to the end 14*a* as drawn to the prescribed length, a light-shielding leader assembling station ST4 for attaching light-shielding shrink films (skirt members also called light-shielding heat-shrink films) 24 to transversely opposite edges of a light-shielding sheet 26 and attaching a pair of end fastening tapes 28 to the leading end of the light-shielding sheet 26, thus assembling a light-shielding leader (packaging sheet) 22, and a light-shielding leader winding station ST5 for winding the light-shielding leader 22 around the photosensitive roll 12 after the light-shielding leader 22 is attached to the end 14*a*. The photosensitive roll 12 can be fed in the direction indicated by the arrow Y by a feeding system 40.

Figure 2:
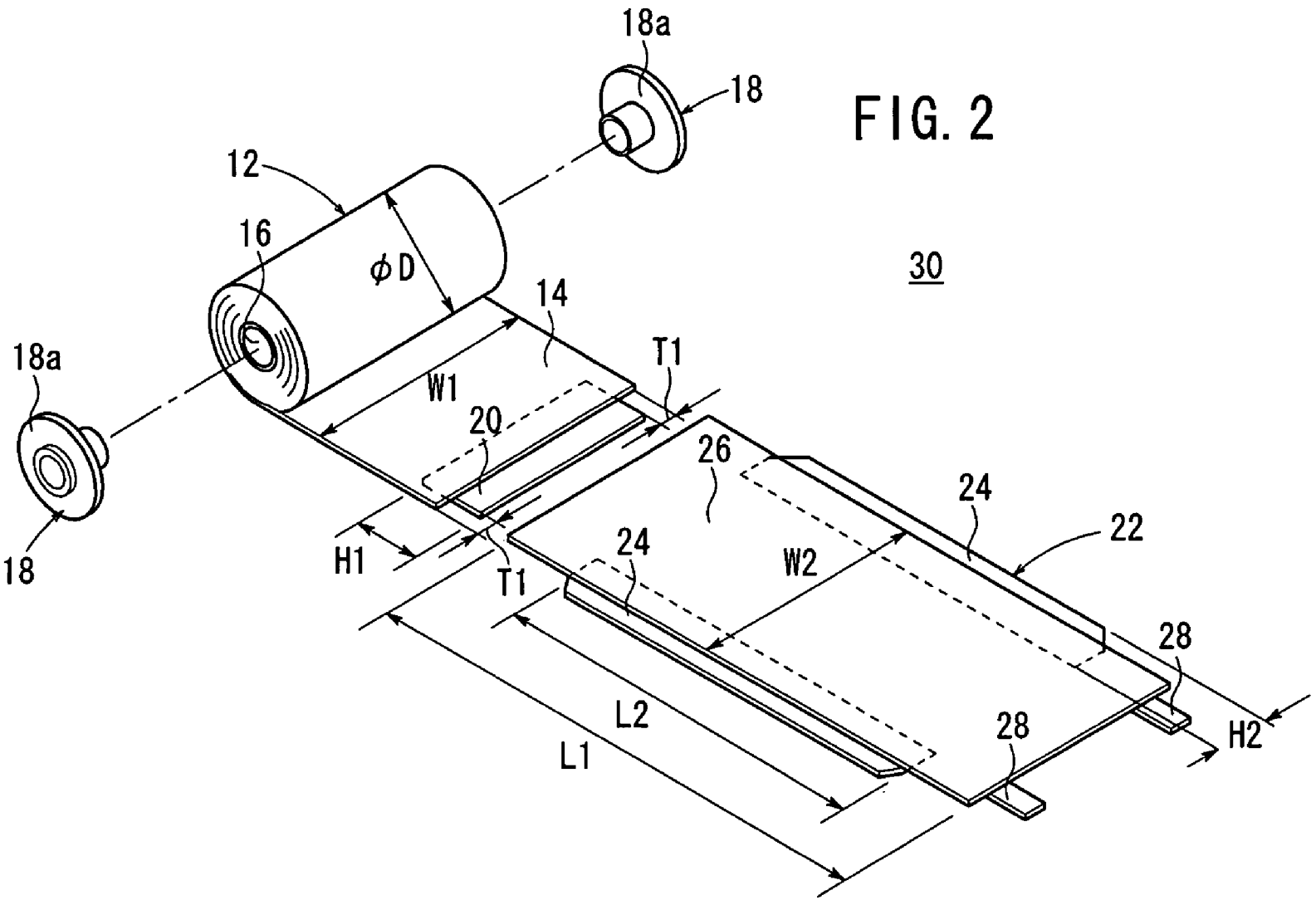
FIG. 2 is an exploded perspective view of a photosensitive roll as the rolled article.

As shown in FIG. 2, the light-shielding leader 22 comprises a light-shielding sheet 26 and two light-shielding shrink films 24 attached respectively to transversely opposite edges of the light-shielding sheet 26. The light-shielding sheet 26 and the photosensitive sheet 14 are joined to each other by a joint tape 20. A pair of laterally spaced end fastening tapes 28 are attached to the leading end of the light-shielding sheet 26. The light-shielding leader 22 is wound around the photosensitive roll 12 and fastened thereto by the end fastening tapes 28, thus making up the light-shielded photosensitive roll 30. The light-shielding leader 22 and the light-shielding shrink films 24 may be integrally formed of the material of the light-shielding shrink films 24.

In the present embodiment, the joint tape 20 has a width H1 of 25 mm, for example, and includes a substantially half portion projecting from the end 14*a* of the photosensitive sheet 14, the substantially half portion having a width which is substantially half the width H1, i.e., a width of 12.5 mm±1 mm. The joint tape 20 has opposite ends spaced inwardly from the transversely opposite edges of the photosensitive sheet 14 by a distance T1 in the range from 0 to 10 mm.

The photosensitive roll 12 has a diameter D, the photosensitive sheet 14 has a width W1, the light-shielding sheet 26 has a width W2 and a length L1, and the light-shielding shrink films 24 each have a width H2 and a length L2. Preferably, the width W2 is substantially equal to the width W1 (W2≈W1) or slightly greater than the width W1 (W2>W1). Preferably, the length L2 is related to the diameter D by L2>3.14×D, and the lengths L1, L2 are related to each other by L1>L2+200 mm.

The light-shielding sheet 26 has an end superposed on and bonded to the end 14*a* of the photosensitive sheet 14 by the joint tape 20, the bonded end of the light-shielding sheet 26 having a width of about 20 mm. The width H2 of each of the light-shielding shrink films 24 is 25 mm, for example, and the light-shielding shrink films 24 have respective outer edges projecting outwardly from the outer edges of the light-shielding sheet 26 preferably by a distance of 9 mm. Preferably, the length L1 of the light-shielding sheet 26 is 900 mm, for example, and the length L2 of each of the light-shielding shrink films 24 is 500 mm or 600 mm, for example.

As shown in FIG. 1, the feeding system 40 has a pair of parallel feed conveyors 42*a*, 42*b* spaced a predetermined distance from each other, and a plurality of pallets 44 removably disposed on the feed conveyors 42*a*, 42*b*. A pair of placement bases 46*a*, 46*b*, each having a substantially V-shaped cross section, is movably mounted on the upper surface of each of the pallets 44. A photosensitive roll 12 is placed on the placement bases 46*a*, 46*b*.

The light-shielding member inserting station ST1 has a light-shielding member assembling mechanism 50 for assembling light-shielding members 18 on respective opposite ends of a photosensitive roll 12, and the end drawing station ST2 has an end drawing mechanism 52 for gripping and drawing an end 14*a* to a prescribed length. The attaching station ST3 has a joint tape attaching mechanism 54 for attaching a joint tape 20 to the end 14*a*.

The light-shielding leader assembling station ST4 has a skirt member processing mechanism 62 for processing a light-shielding shrink film 24 from a film roll 60, an attaching mechanism 66 for producing a light-shielding sheet 26 from an elongate leader 64 and attaching a light-shielding shrink film 24 to the light-shielding sheet 26, and an end fastening tape supplying and attaching mechanism 70 for supplying and attaching end fastening tapes 28 to the leading end of a light-shielding sheet 26.

The light-shielding leader winding station ST5 has a packaging apparatus 100 according to an embodiment of the present invention.

Figure 3:
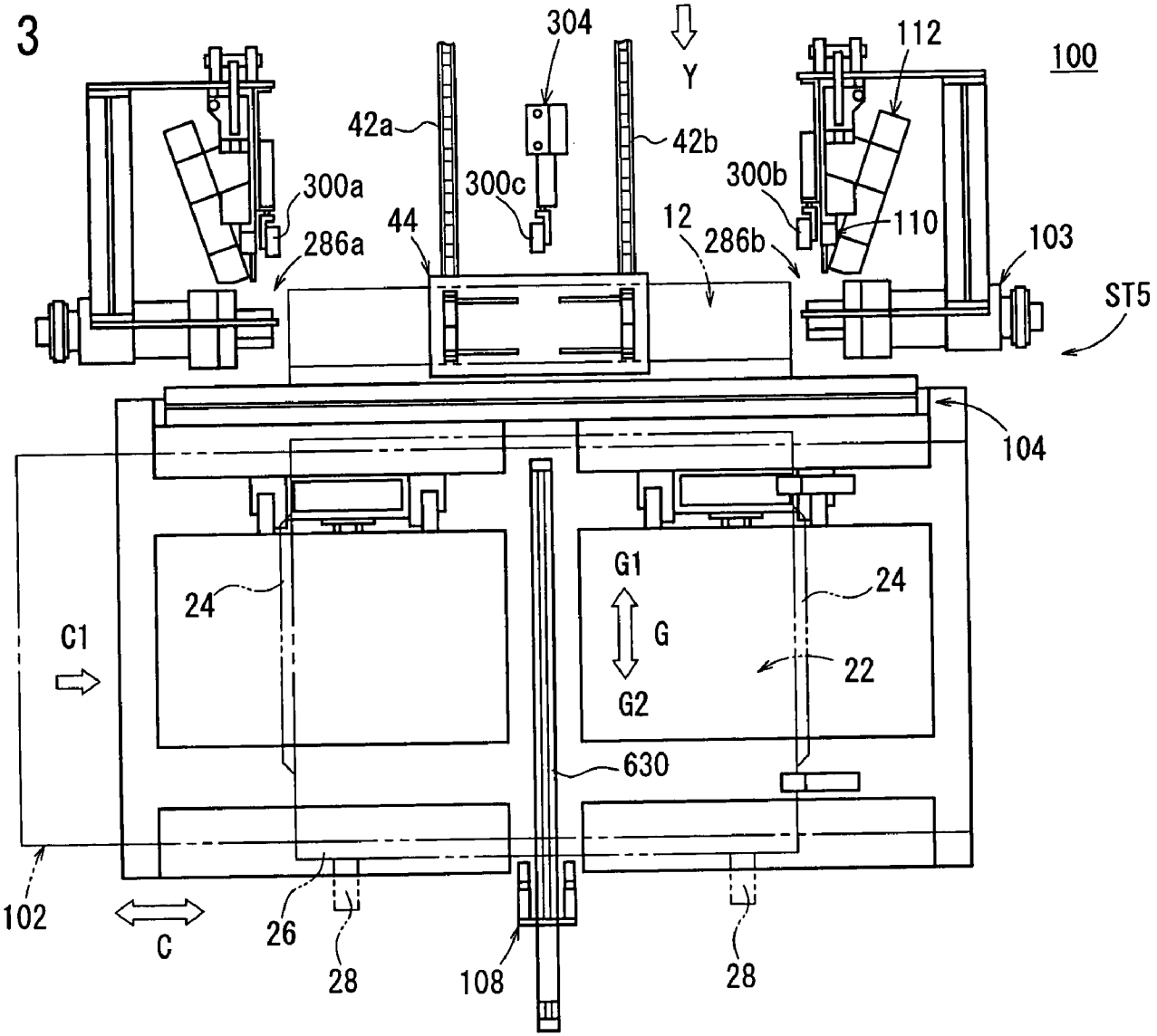
FIG. 3 is a plan view of a packaging apparatus according to an embodiment of the present invention.

As shown in FIG. 3, the packaging apparatus 100 comprises a light-shielding leader feed mechanism (packaging sheet feed mechanism) 102 for gripping the end of the light-shielding leader 22 and feeding and positioning the end of the light-shielding leader 22 in a winding position P1, a rotating and supporting mechanism 103 for positioning the photosensitive roll 12 with respect to the light-shielding leader 22 and rotating the photosensitive roll 12, an attaching mechanism 104 for attaching the light-shielding leader 22 to the end 14*a* of the photosensitive sheet 14, and a light-shielding leader holding mechanism (packaging sheet holding mechanism) 108 for gripping and moving the winding terminal end of the light-shielding leader 22 to the photosensitive roll 12 when the photosensitive roll 12 is rotated.

The packaging apparatus 100 also has a pressing mechanism 110 for pressing the outer circumferential edge portions 18*a* of the light-shielding members 18 against the opposite ends of the photosensitive roll 12, and a skirt processing mechanism 112 for processing the light-shielding shrink films 24 so as to cover the outer circumferential edge portions 18*a* of the light-shielding members 18.

Figure 4:
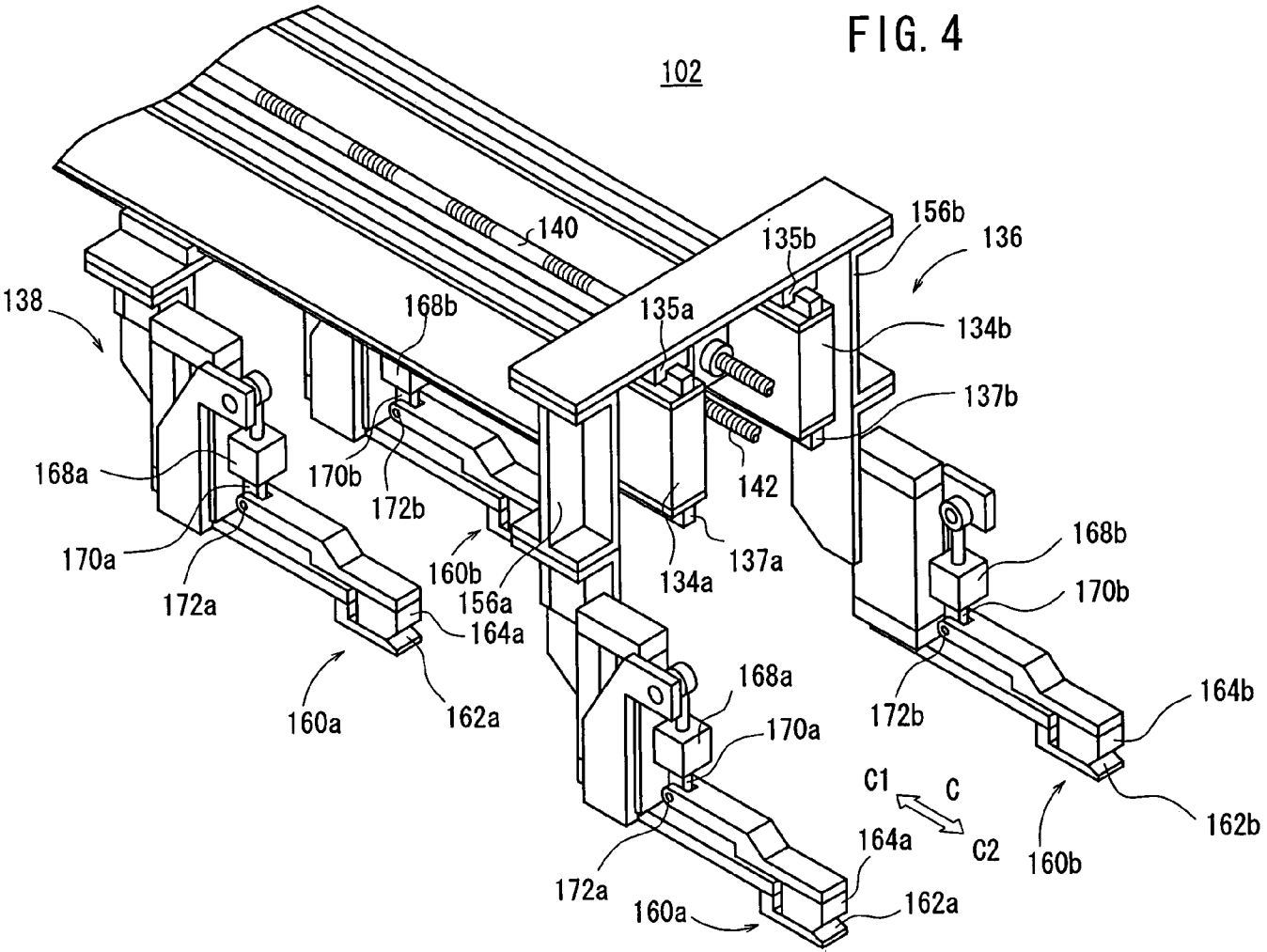
FIG. 4 is a perspective view of a light-shielding leader feeding mechanism of the packaging apparatus.
Figure 5:
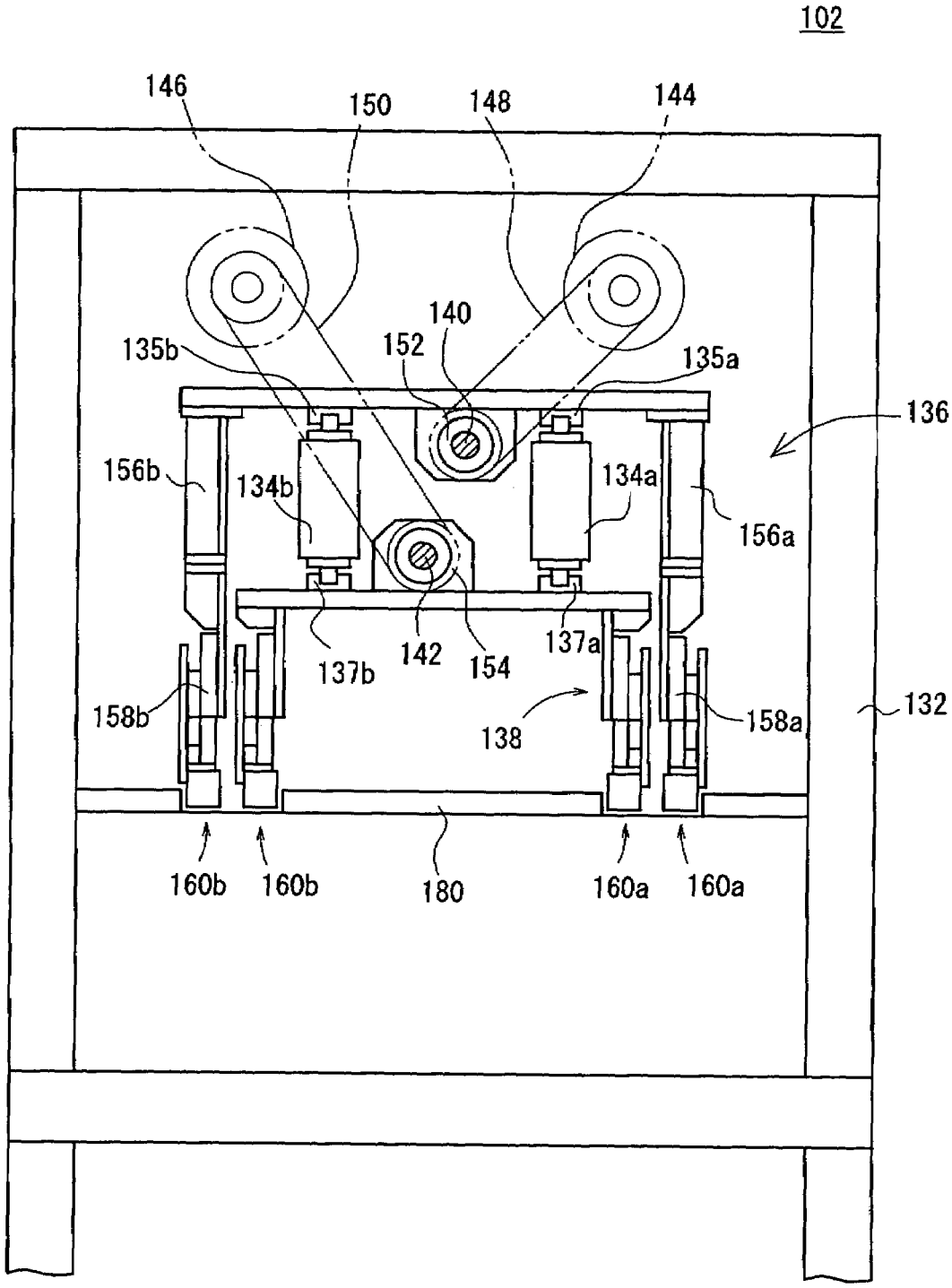
FIG. 5 is a front elevational view of the light-shielding leader feeding mechanism.

As shown in FIGS. 4 and 5, the light-shielding leader feed mechanism 102 has a pair of horizontally extending rails 134*a*, 134*b* supported on an upper portion of a frame 132 which extends from the light-shielding leader assembling station ST4 to the light-shielding leader winding station ST5. On the rails 134*a*, 134*b*, there are movably mounted first and second feed units 136, 138 for selectively feeding light-shielding leaders 22 having different lengths.

Upper linear guides 135*a*, 135*b* and lower linear guides 137*a*, 137*b* are mounted on the rails 134*a*, 134*b*, between which there are rotatably supported first and second ball screws 140, 142. The first and second ball screws 140, 142 can individually be rotated by belt and pulley means 148, 150 which are coupled to respective motors 144, 146 fixed to an end of the frame 132.

The first feed unit 136 has a nut 152 threaded over the first ball screw 140, and is supported by the upper linear guides 135*a*, 135*b* for movement in the directions indicated by the arrow C. The second feed unit 138 has a nut 154 threaded over the second ball screw 142, and is supported by the lower linear guides 137*a*, 137*b* for movement in the directions indicated by the arrow C.

Figure 6:
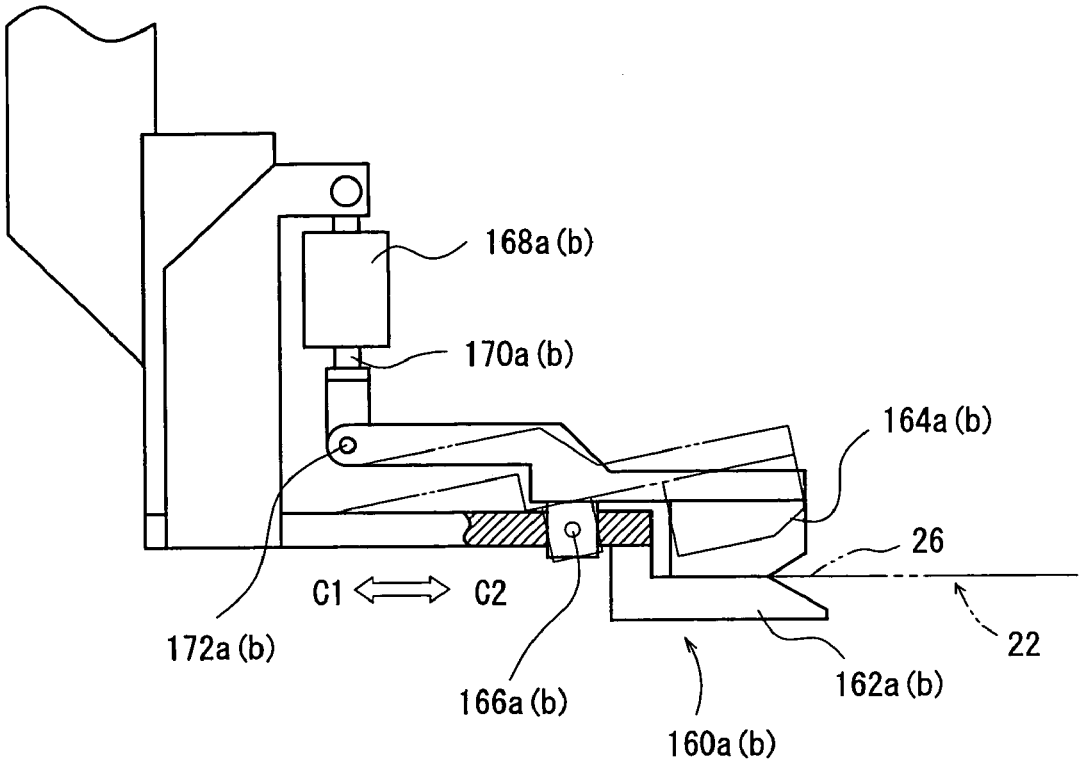
FIG. 6 is a view illustrative of the manner in which a clamp means of the light-shielding leader feeding mechanism operates.

Arms 156*a*, 156*b* extend downwardly from the first feed unit 136, and support on their lower ends clamp means 160*a*, 160*b* through vertically movable tables 158*a*, 158*b* which are actuatable under air pressure. As shown in FIGS. 4 and 6, the clamp means 160*a*, 160*b* have fixed fingers 162*a*,

162*b* and swing fingers 164*a*, 164*b*. The swing fingers 164*a*, 164*b* are swingable about respective pivot shafts 166*a*, 166*b* and have rear ends connected by respective hinge pins 172*a*, 172*b* to respective rods 170*a*, 170*b* extending downwardly from cylinders 168*a*, 168*b*.

The second feed unit 138 is identical in structure to the first feed unit 136. Therefore, the components of the second feed unit 138 which are identical to those of the first feed unit 136 are denoted by identical reference characters, and will not be described in detail below.

Figure 7:
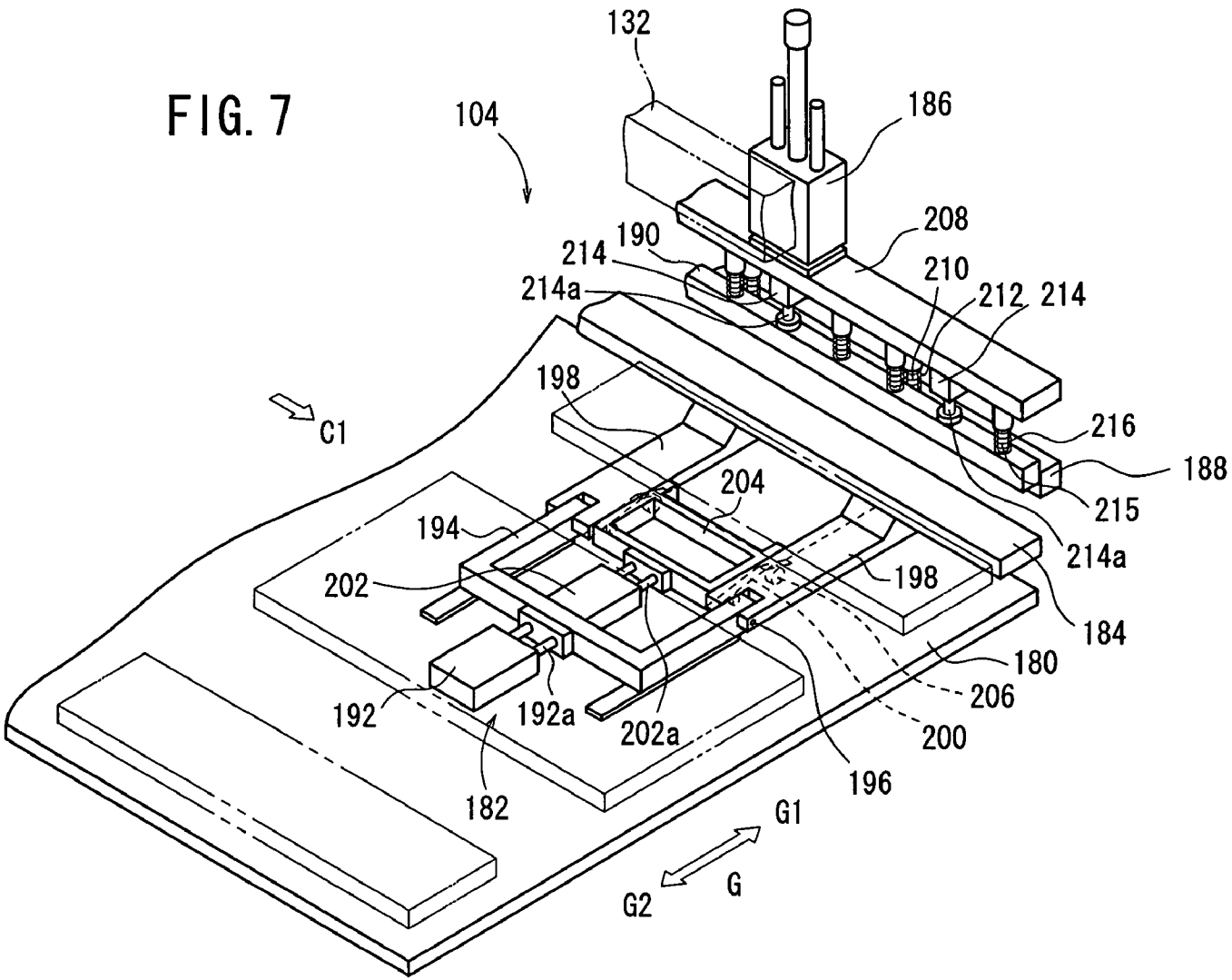
FIG. 7 is a perspective view of an attaching mechanism of the packaging apparatus.
Figure 8:
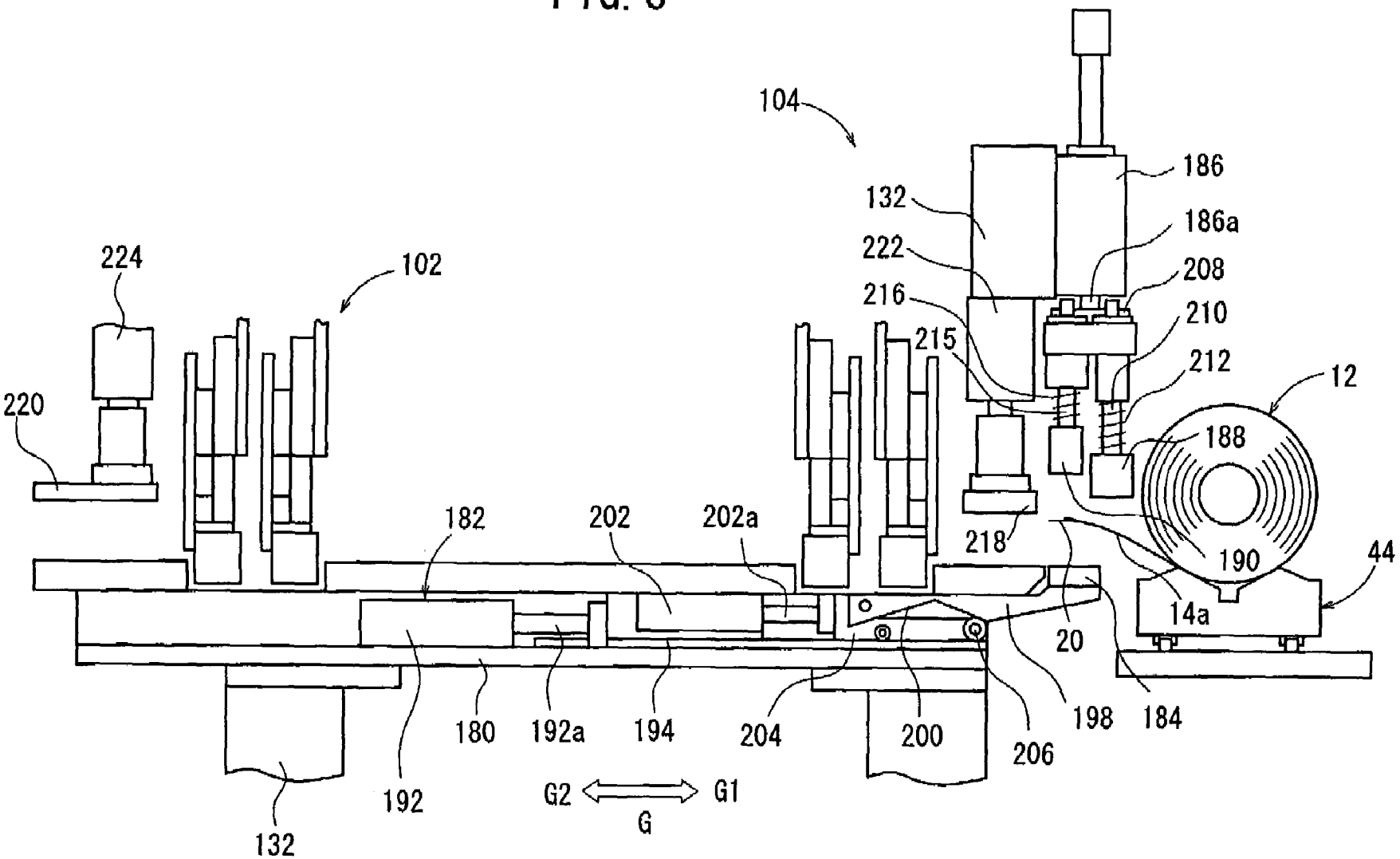
FIG. 8 is a side elevational view of the attaching mechanism.

As shown in FIGS. 7 and 8, the attaching mechanism 104 has a movable bearing base 184 which is movable by an actuator 182 mounted on a base 180 of the frame 132, and first and second presser members 188, 190 disposed above the bearing base 184 and vertically movable by a lifting and lowering cylinder 186.

The actuator 182 has a first cylinder 192 mounted on the base 180 and having rods 192*a* which extend therefrom in the direction indicated by the arrow G1 and are connected to a movable base 194. Arms 198 are swingably supported by a pair of pivot shafts 196 on a distal end of the movable base 194 in the direction indicated by the arrow G1. The movable bearing base 184 is integrally fixed to distal ends of the arms 198. The arms 198 have respective angularly concave cam surfaces 200 on their lower surfaces.

A second cylinder 202 is mounted centrally on the movable base 194 and has rods 202*a* which extend therefrom in the direction indicated by the arrow G1 and are connected to a cam plate 204. Cam rollers 206 engaging the cam surfaces 200 of the arms 198 are mounted on opposite ends of the cam plate 204.

The lifting cylinder 186 is fixed to the frame 132 and has a downwardly extending rod 186a to which an attachment plate 208 is fixed. The first presser member 188, which is positioned closely to the photosensitive roll 12, is connected to the attachment plate 208 by a plurality of guide bars 210, with springs 212 disposed around the respective guide bars 210. The attachment plate 208 supports thereon a plurality cylinders 214 spaced from the guide bars 210 in the direction indicated by the arrow G2 and having respective downwardly extending rods 214*a* to which the second presser member 190 is fixed. The second presser member 190 is movable toward and away from the attachment plate 208 by the cylinders 214 while being guided by rods 215 and springs 216 disposed therearound.

Figure 14:
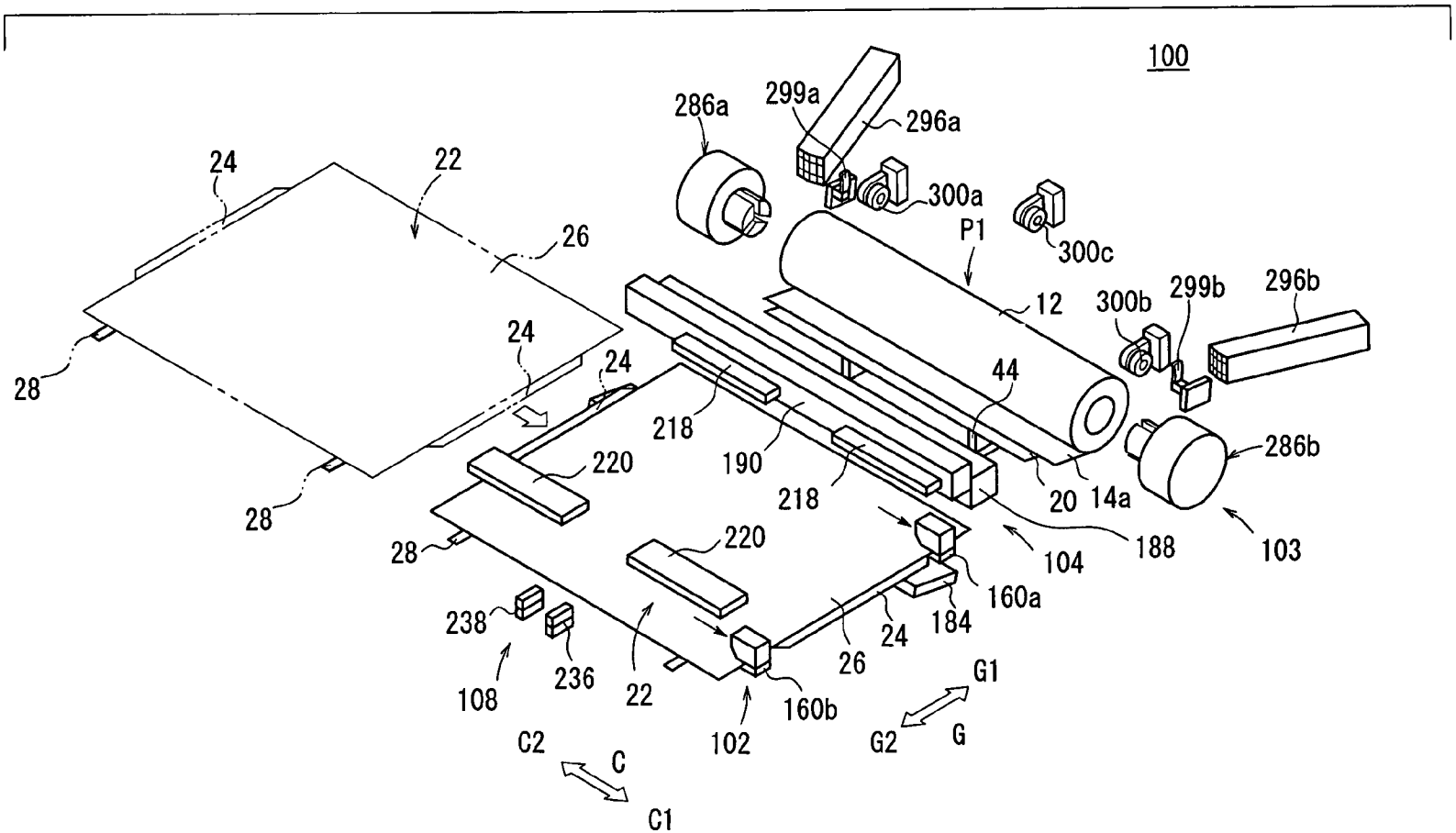
FIG. 14 is a perspective view of the packaging apparatus, illustrating the manner in which a light-shielding leader is placed into a winding position.

As shown in FIG. 8, light-shielding leader pressers 218, 220 are disposed on the base 180 at its opposite ends spaced in the directions indicated by the arrow G. The light-shielding leader pressers 218, 220 extend in the directions indicated by the arrow C (see FIG. 14), and are vertically movable by respective lifting cylinders 222, 224. The light-shielding leader holding mechanism 108 is disposed on the base 180 at a substantially central position in the directions indicated by the arrow C (see FIG. 3).

Figure 9:
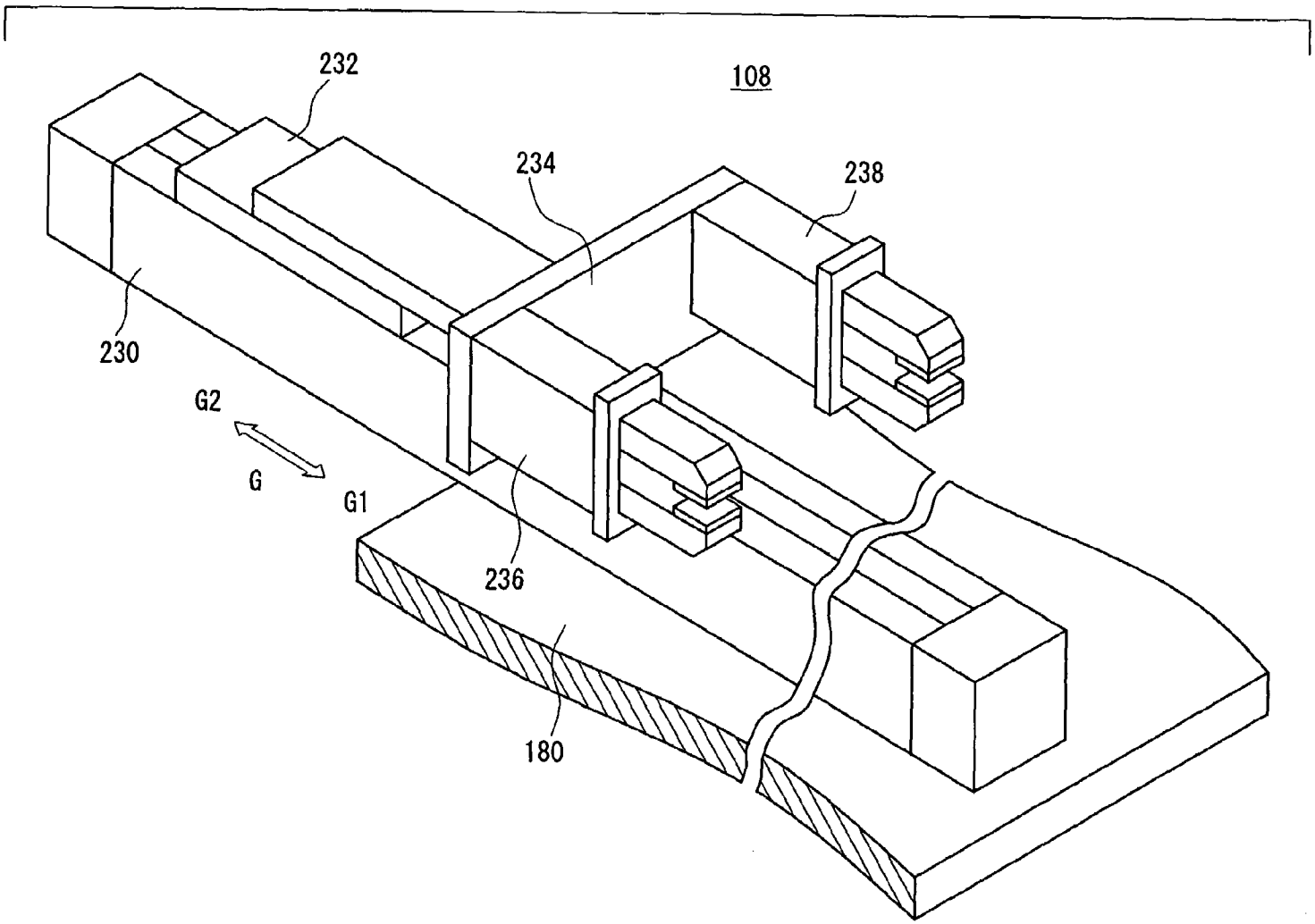
FIG. 9 is a perspective view of a light-shielding leader holding mechanism of the packaging apparatus.

As shown in FIG. 9, the light-shielding leader holding mechanism 108 has a rodless cylinder 230 mounted on the base 180 and extending in the directions indicated by the arrow G. A support plate 234 is fixed to a movable base 232 which is movable in the directions indicated by the arrow G by the rodless cylinder 230. Air chucks 236, 238 are mounted on the support plate 234 in respective positions which are equally spaced laterally from a transversely central line of the light-shielding leader 22.

Figure 10:
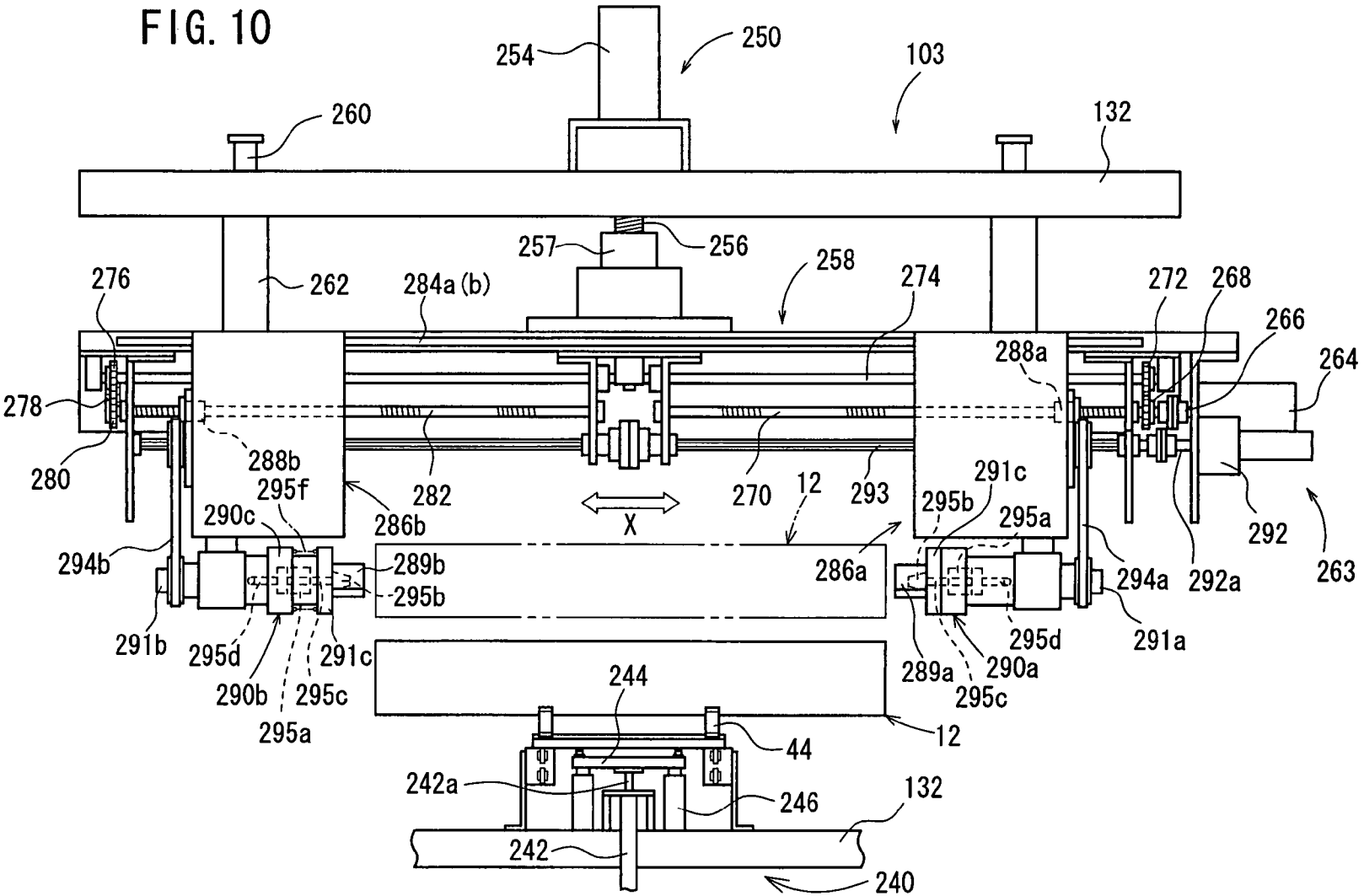
FIG. 10 is a front elevational view of a rotating and supporting mechanism and a pallet lifting mechanism of the packaging apparatus.

As shown in FIG. 10, the photosensitive roll 12 is supported on a pallet lifting mechanism 240 in a position below the rotating and supporting mechanism 103. The pallet lifting mechanism 240 has a cylinder 242 fixed to the frame 132. The cylinder 242 has an upwardly extending rod 242*a* to which a vertically movable base 244 is secured. Guide bars 246 mounted on the vertically movable base 244 are vertically movably supported by the frame 132. The pallet 44 can be placed on the vertically movable base 244.

Figure 11:
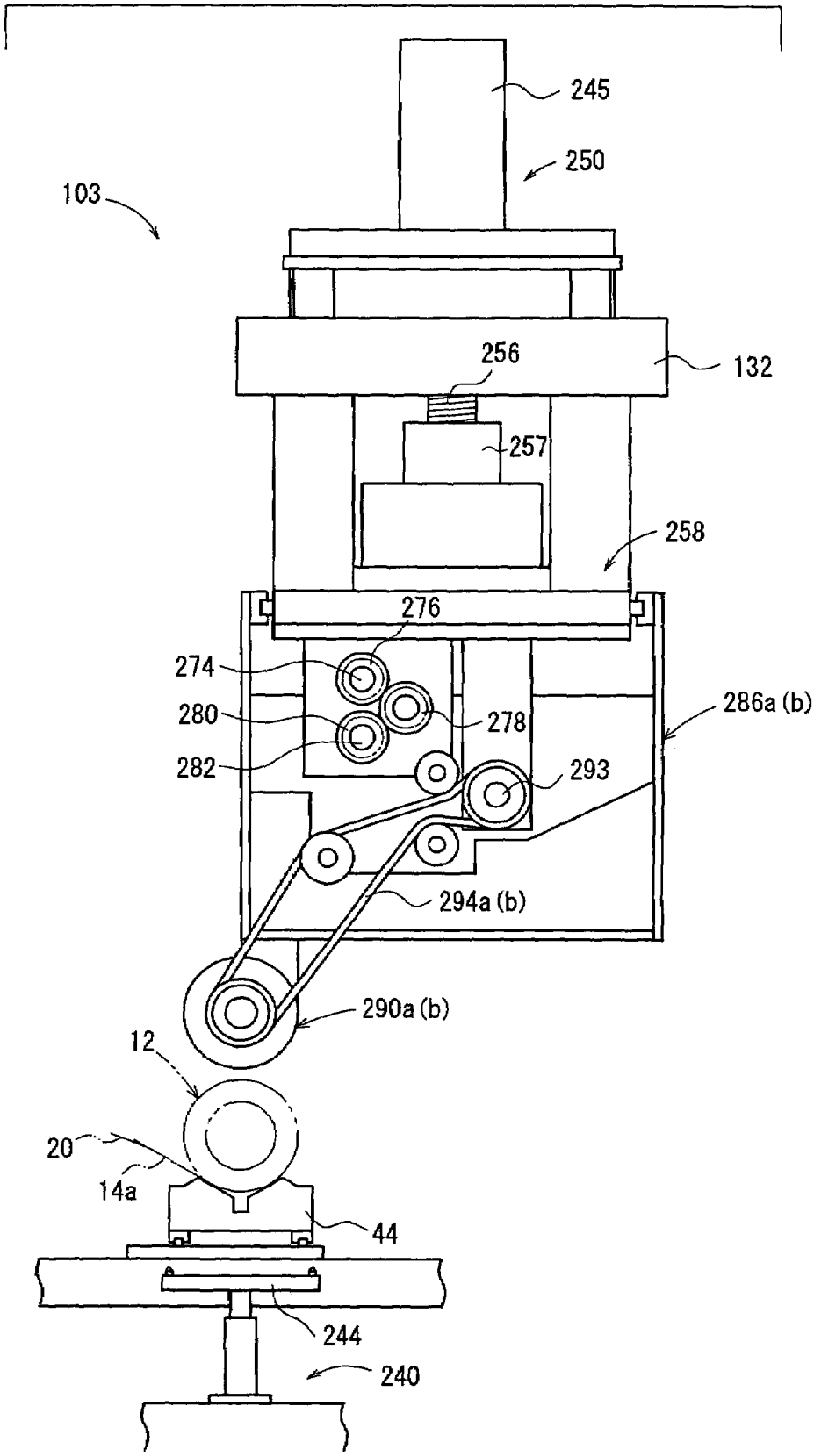
FIG. 11 is a side elevational view of the rotating and supporting mechanism and the pallet lifting mechanism.

The rotating and supporting mechanism 103 has a moving unit 250 mounted on the frame 132. As shown in FIGS. 10 and 11, the moving unit 250 has a motor 254 fixedly mounted on the frame 132 and directed downwardly, and having a downwardly extending rotatable drive shaft (not shown) to which a ball screw 256 is coaxially connected. The ball screw 256 is threaded through a nut 257 fixed to a vertically movable frame 258 which extends transversely across the photosensitive roll 12 in the directions indicated by the arrow X. A plurality of guide rods 260 have lower ends screwed to the vertically movable frame 258 and are inserted in respective guide bushings 262 attached to the frame 132.

A drive unit 263 has a motor 264 mounted on a longitudinal end of the vertically movable frame 258 and having a rotatable drive shaft 266 to which there are coaxially fixed a drive gear 268 and a first ball screw 270. The drive gear 268 is held in mesh with a driven gear 272 fixedly mounted on an end of a rotatable shaft 274 whose opposite ends and central portion are rotatably supported on the vertically movable frame 258.

The rotatable shaft 274 has a first gear 276 mounted on an end thereof remote from the driven gear 272 and held in mesh with a second gear 278 meshing with a third gear 280. The third gear 280 is mounted on an end of a second ball screw 282 which is coaxial with the first ball screw 270 and is rotatably supported on the vertically movable frame 258.

The vertically movable frame 258 has a set of guide rails 284*a*, 284*b* extending parallel to the first and second ball screws 270, 282, and first and second slide units 286*a*, 286*b* are slidably supported on the guide rails 284*a*, 284*b*. The first and second slide units 286*a*, 286*b* support first and second nuts 288*a*, 288*b* fixed thereto which are threaded respectively over the first and second ball screws 270, 282. First and second chucks 290*a*, 290*b* are rotatably supported on lower surfaces of the first and second slide units 286*a*, 286*b*, respectively. The first and second chucks 290*a*, 290*b* have first and second radially expandable and contractible claws 289*a*, 289*b* that are insertable in the opposite ends of the core 16 of the photosensitive roll 12 and movable radially inwardly and outwardly in the core 16.

A motor 292 is mounted on the longitudinal end of the vertically movable frame 258 in juxtaposed relation to the motor 264, and has a rotatable drive shaft 292*a* to which a splined shaft 293 is coaxially connected. The splined shaft 293 extends in the directions indicated by the arrow X and is rotatably supported on the vertically movable frame 258. The first and second chucks 290*a*, 290*b* have respective rotatable shafts 291*a*, 291*b* that are operatively coupled to the opposite ends of the splined shaft 293 respectively by belt and pulley means 294*a*, 294*b*.

The first and second chucks 290*a*, 290*b* have cylinder chambers 295*a* defined respectively therein which accommodate therein respective shafts 295*c* supporting respective cam members 295*b* for back-and-forth movement to radially expand and contract the first and second radially expandable and contractible claws 289*a*, 289*b*. The shafts 295*c* are disposed coaxially with the rotatable shafts 291*a*, 291*b*, and are biased to move toward the belt and pulley means 294*a*, 294*b* by springs (not shown) as biasing means. The cylinder chambers 295*a* are held in communication with respective fluid passages 295*d* having respective solenoid-operated valves or the like for selectively connecting the fluid passages 295*d* to a pressure fluid source (positive pressure source) and a negative pressure source (not shown).

The second radially expandable and contractible fingers 289*b* and an end face member 291*c* of the second chuck 290*b* are supported on a chuck body 290*c*. A spring 295*f* as a resilient means is interposed between the chuck body 290*c* and the end face member 291*c* for biasing the end face member 291*c* and the second radially expandable and contractible fingers 289*b* toward the photosensitive roll 12.

Figure 12:
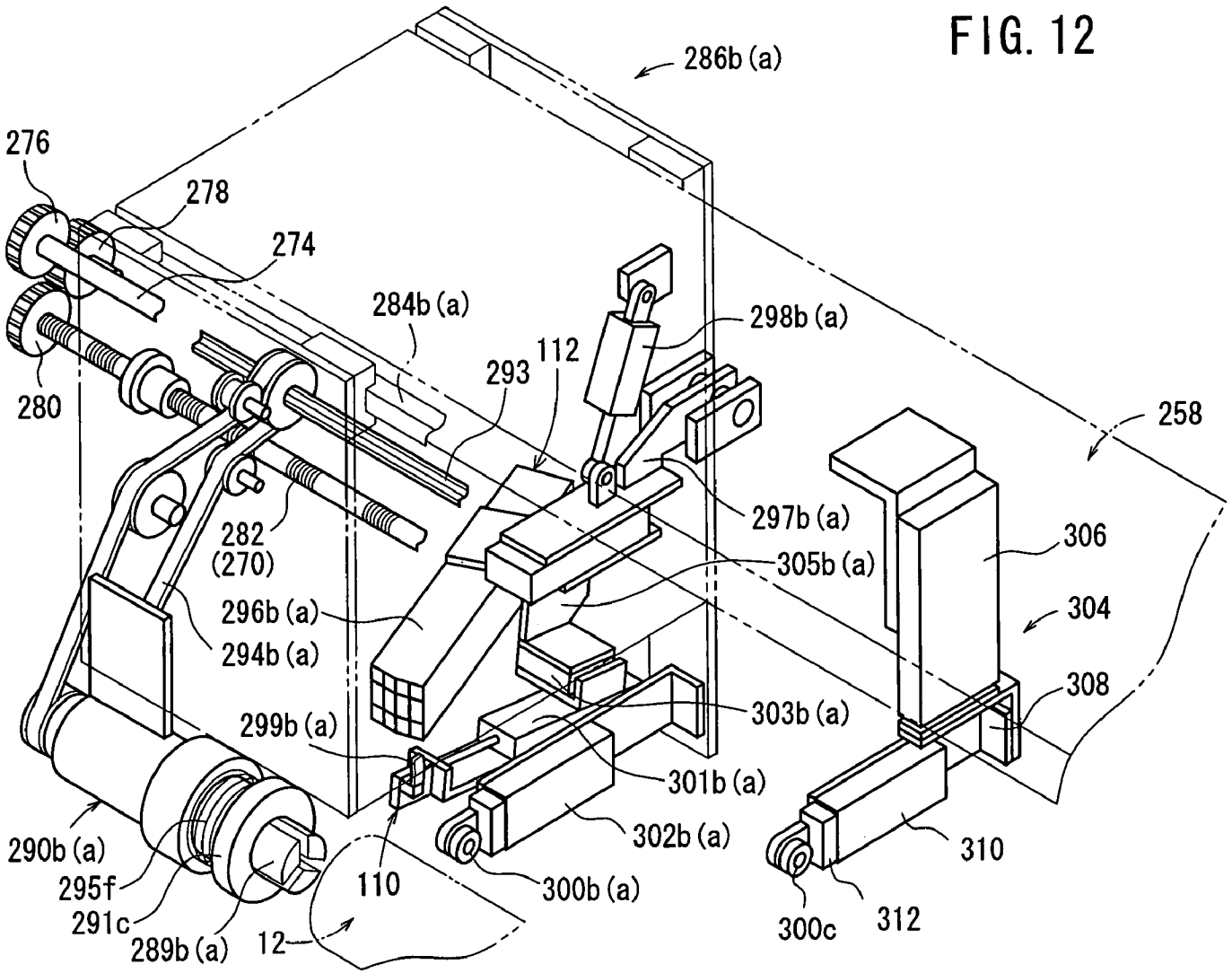
FIG. 12 is a perspective view of a slide unit of the rotating and supporting mechanism.
Figure 13:
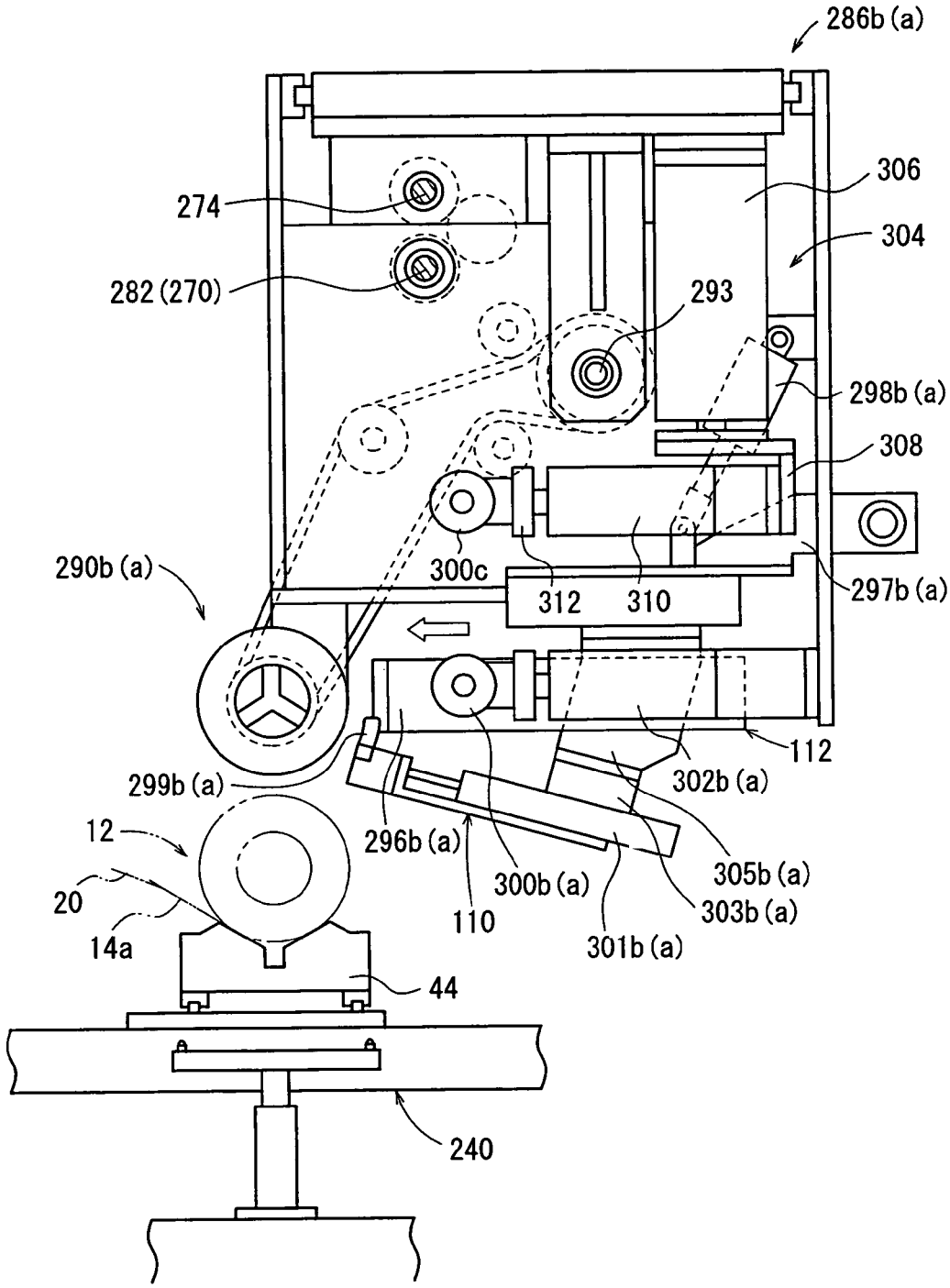
FIG. 13 is a side elevational view of the slide unit.

As shown in FIGS. 12 and 13, the skirt processing mechanism 112 has hot air blowers 296*a*, 296*b* for continuously supplying hot air at a constant temperature at a constant rate to the light-shielding shrink films 24 upon rotation of the photosensitive roll 12, and support members 297*a*, 297*b* such as brackets or the like supporting the hot air blowers 296*a*, 296*b*, respectively, that are swingably movable by respective cylinders 298*a*, 298*b*. The support members 297*a*, 297*b* are mounted respectively on the first and second slide units 286*a*, 286*b*.

The pressing mechanism 110 comprises pressers 299*a*, 299*b* for pressing the outer circumferential edge portions 18*a* of the light-shielding members 18 against the respective opposite ends of the photosensitive roll 12, cylinders 301*a*, 301*b* for moving the respective pressers 299*a*, 299*b* radially of the photosensitive roll 12, and cylinders 303*a*, 303*b* for moving the respective pressers 299*a*, 299*b* in the directions indicated by the arrow X with respect to the opposite ends of the photosensitive roll 12. The pressing mechanism 110 is disposed below the hot air blowers 296*a*, 296*b* and mounted on the support members 297*a*, 297*b* by respective brackets 305*a*, 305*b*. Therefore, the pressing mechanism 110 is swingably supported, together with the hot air blowers 296*a*, 296*b*, by the support members 297*a*, 297*b*. In the present embodiment, the pressers 299*a*, 299*b* are in the form of arcuate tongues extending substantially along the outer circumferential edges of the photosensitive roll 12.

Rollers 300*a*, 300*b* for pressing the light-shielding leader 22 against the photosensitive roll 12 while the winding terminal end of the light-shielding leader 22 is being released from the light-shielding leader holding mechanism 108 when the light-shielding leader 22 is wound are mounted on the respective first and second slide units 286*a*, 286*b*. The rollers 300*a*, 300*b* are horizontally movable by horizontal cylinders 302*a*, 302*b*, respectively.

A roller 300*c* which is movable by an actuator 304 is mounted on the vertically movable frame 258. The actuator 304 has a vertical first cylinder 306 which lifts and lowers an attachment plate 308 having a vertical surface on which a horizontal second cylinder 310 is fixedly mounted. The second cylinder 310 horizontally moves a plate 312 with the roller 300*c* being rotatably supported thereon.

Operation and advantages of the packaging system 10 thus constructed will be described below with respect to a method of packaging a photosensitive roll 12.

A photosensitive roll 12 with the end 14*a* of the photosensitive sheet 14 being a free end is placed on a pallet 44, and fed by the pallet 44 to the light-shielding member inserting station ST1 by the feed conveyors 42*a*, 42*b*. After having been stopped in the light-shielding member inserting station ST1, the photosensitive roll 12 is lifted off the feed conveyors 42*a*, 42*b* to a predetermined insertion height by a pallet lifting mechanism (not shown). The light-shielding member assembling mechanism 50 operates to assemble light-shielding members 18 on the respective opposite ends of the photosensitive roll 12, after which the pallet 44 is lowered back onto the feed conveyors 42*a*, 42*b* (see FIG. 1).

Then, the pallet 44 is delivered to the end drawing station ST2. In the end drawing station ST2, the end drawing mechanism 52 operates to draw the end 14*a* of the photosensitive roll 12 to a prescribed length and position the end 14*a*. The photosensitive roll 12 placed on the pallet 44 is delivered to the attaching station ST3 where the joint tape attaching mechanism 54 operates to attach a joint tape 20 to the end 14*a* of the photosensitive roll 12 (see FIG. 1).

The photosensitive roll 12 is fed from the attaching station ST3 to the light-shielding leader winding station ST5. In the light-shielding leader assembling station ST4, a light-shielding shrink film 24 is processed from the film roll 60 by the skirt member processing mechanism 62. In addition, a light-shielding sheet 26 is produced from the elongate leader 64, and attached to the light-shielding shrink film 24 by the attaching mechanism 66. End fastening tapes 28 are supplied and attached to the leading end of the light-shielding sheet 26 by the end fastening tape supplying and attaching mechanism 70, whereupon a light-shielding leader 22 is produced.

Then, the light-shielding leader 22 is fed to the light-shielding leader winding station ST5 by the light-shielding leader feed mechanism 102, as shown in FIGS. 3 through 6.

Specifically, the motor 144 of the first feed unit 136 is energized to rotate the first ball screw 140. When the first ball screw 140 is rotated, the nut 152 threaded over the first ball screw 140 moves the first feed unit 136 in the direction indicated by the arrow C2 while the first feed unit 136 is being guided by the rails 134*a*, 134*b*. While the clamp means 160*a*, 160*b* of the first feed unit 136 are being moved into a position corresponding to the light-shielding leader 22, the cylinders 168*a*, 168*b* are actuated to turn the swing fingers 164*a*, 164*b* about the respective pivot shafts 166*a*, 166*b* in a direction to shift their distal ends upwardly.

When the first feed unit 136 moves toward the light-shielding sheet 26 of the light-shielding leader 22, the opposite edges of the light-shielding sheet 26 are inserted between the fixed fingers 162*a*, 162*b* and the swing fingers 164*a*, 164*b*, as indicated by the two-dot-and-dash lines in FIG. 6. Then, the cylinders 168*a*, 168*b* are actuated to close the distal ends of the swing fingers 164*a*, 164*b*, gripping the opposite edges of the light-shielding sheet 26 between the swing fingers 164*a*, 164*b* and the fixed fingers 162*a*, 162*b*.

The motor 144 is then reversed to rotate the first ball screw 140 in the opposite direction, enabling the nut 152 to move the first feed unit 136 in the direction indicated by the arrow C1. The light-shielding leader 22 gripped by the clamp means 160*a*, 160*b* is moved in the direction indicated by the arrow C1 to the light-shielding leader winding station ST5 (see FIG. 14). Since the light-shielding leader 22 is fed while it is being gripped by the clamp means 160*a*, 160*b*, the light-shielding leader 22 is prevented from being positioned in error, but can accurately be positioned in the winding position P1.

Figure 15:
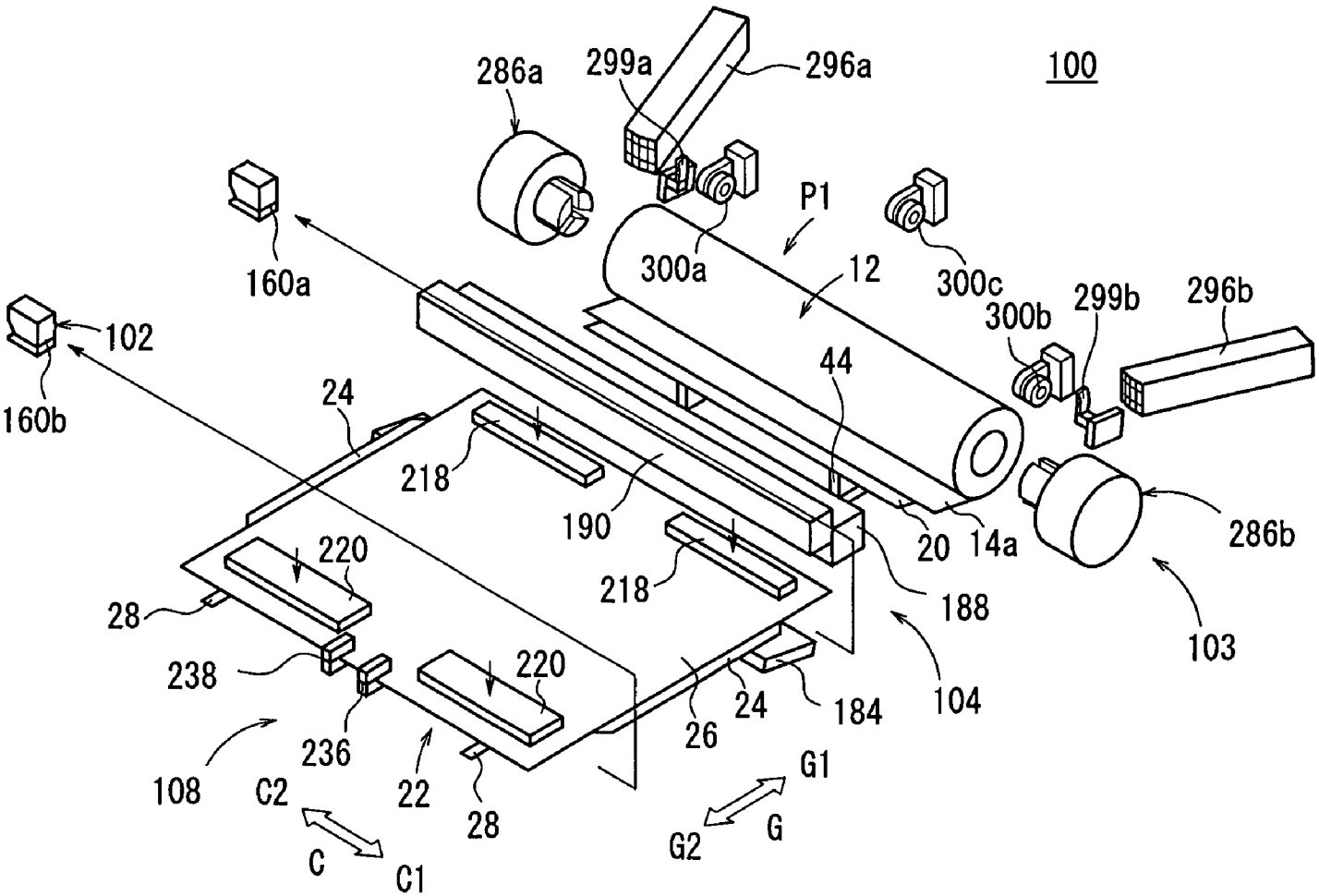
FIG. 15 is a perspective view of the packaging apparatus, illustrating the manner in which a light-shielding leader is held in place.

In the light-shielding leader winding station ST5, the cylinders 222, 224 are actuated to lower the light-shielding leader pressers 218, 220 until the opposite ends of the light-shielding leader 22 in the directions indicated by the arrow G are pressed between light-shielding leader pressers 218, 220 and the placement surface of the base 180 (see FIG. 15). Then, the air chucks 236, 238 grip the winding end of the light-shielding leader 22, and the clamp means 160*a*, 160*b* of the light-shielding leader feed mechanism 102 release the end of the light-shielding leader 22 in the directions indicated by the arrow C1. The clamp means 160*a*, 160*b* are moved upwardly by the vertically movable tables 158*a,* 158*b* and moved in the direction indicated by the arrow C2 by the motor 144.

In the winding position P1, the light-shielding leader 22 is positioned as described above, and the cylinder 242 is actuated to cause the vertically movable base 244 to elevate the pallet 4. When the photosensitive roll 12 is placed in a winding height position by the pallet 44 as indicated by the two-dot-and-dash lines in FIG. 10, the rotating and supporting mechanism 103 and the attaching mechanism 104 are actuated.

In the rotating and supporting mechanism 103, as shown in FIG. 10, the motor 264 of the drive unit 263 is energized to rotate the drive gear 268 and the first ball screw 270 in unison in a given direction. The drive gear 268 meshing with the driven gear 272 rotates the driven gear 272 whose rotation is transmitted through the rotatable shaft 274 to the first gear 276 and then from the second gear 278 meshing with the first gear 276 through the third gear 280 to the second ball screw 282. The first and second balls crews 270, 282 rotate in different directions, causing the first and second nuts 288*a,* 288*b* to move the first and second slide units 286*a,* 286*b* toward each other.

When the first and second slide units 286*a,* 286*b* move toward each other, the first and second radially expandable and contractible claws 289*a,* 289*b* of the first and second chucks 290*a,* 290*b* are inserted into the respective opposite ends of the core 16 of the photosensitive roll 12, and the end face members 291*c* are pressed against the respective opposite ends of the photosensitive roll 12 so as to be pushed back a predetermined distance of about 3 mm against the resiliency of the springs 295*f*. The photosensitive roll 12 in the winding position P1 is now reliably positioned in the directions indicated by he arrow C with respect to the light-shielding leader 22 which has been positioned as described above. At this time, the spring 295*f* of the second chuck 290*b* is effective in reducing shocks attached to the opposite ends of the photosensitive roll 12 and adjusting pressing forces attached to the photosensitive roll 12. Therefore, the opposite ends of the photosensitive roll 12 are prevented from being damaged.

In the attaching mechanism 104, as shown in FIGS. 7 and 8, the first cylinder 192 of the actuator 182 is actuated to move the movable base 194 in the direction indicated by the arrow G1. Then, the second cylinder 202 is actuated to cause the rod 202*a* to move the cam plate 204 in the direction indicated by the arrow G1, whereupon the cam rollers 206 on the opposite ends of the cam plate 204 engage the cam surfaces 200 on the lower surfaces of the arms 198. Therefore, the arms 198 are guided by the cam surfaces 200 and the cam rollers 206 to swing vertically upwardly.

Figure 16:
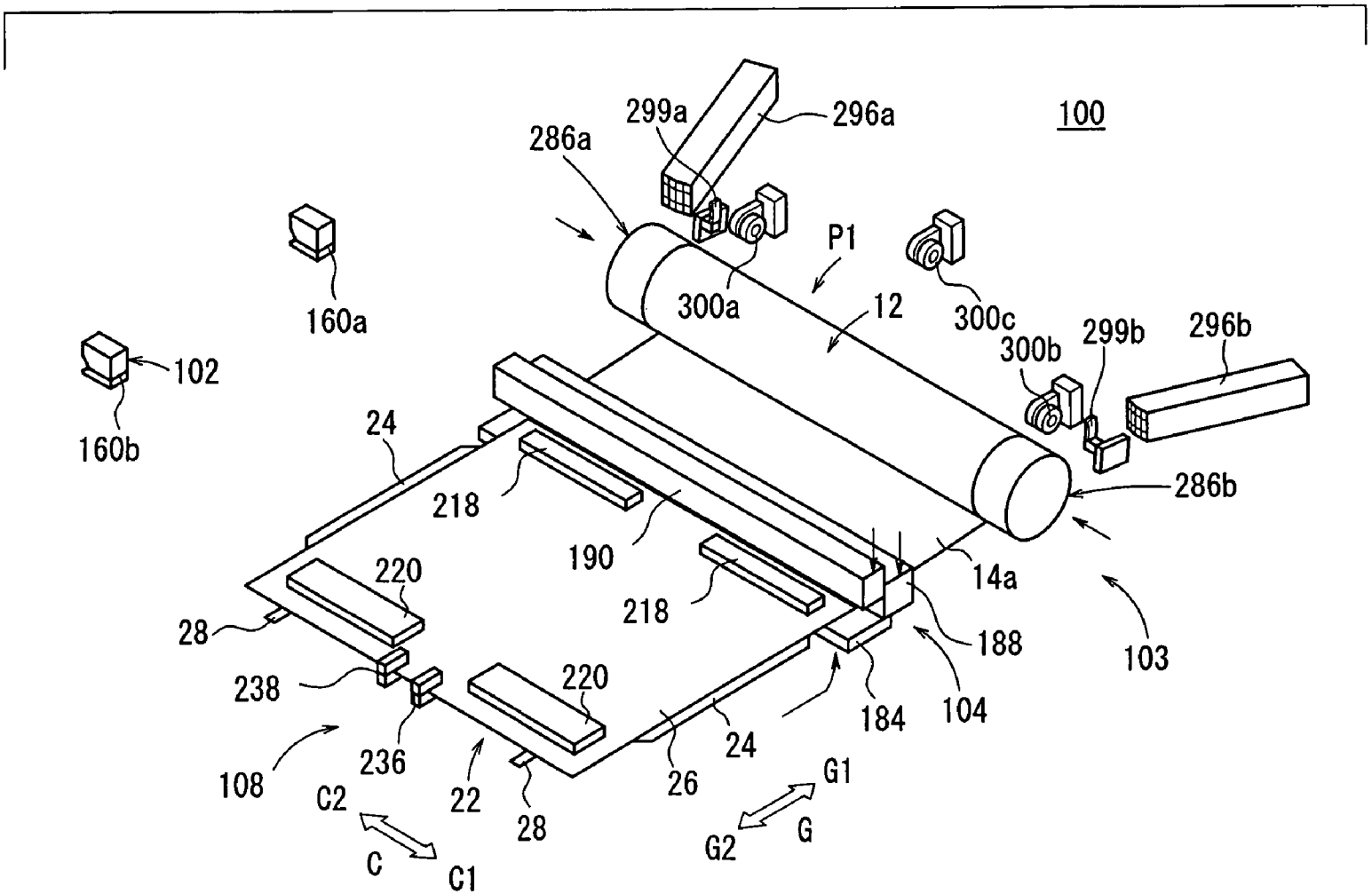
FIG. 16 is a perspective view of the packaging apparatus, illustrating the manner in which the attaching mechanism operates.

The movable bearing base 184 fixed to the arms 198 projects upwardly from the lower surface of the base 180 and is placed between the end of the base 180 and the photosensitive roll 12 (see FIG. 16). The end 14*a* of the photosensitive roll 12 and the joint tape 20 are placed on the movable bearing base 184.

Figure 17:
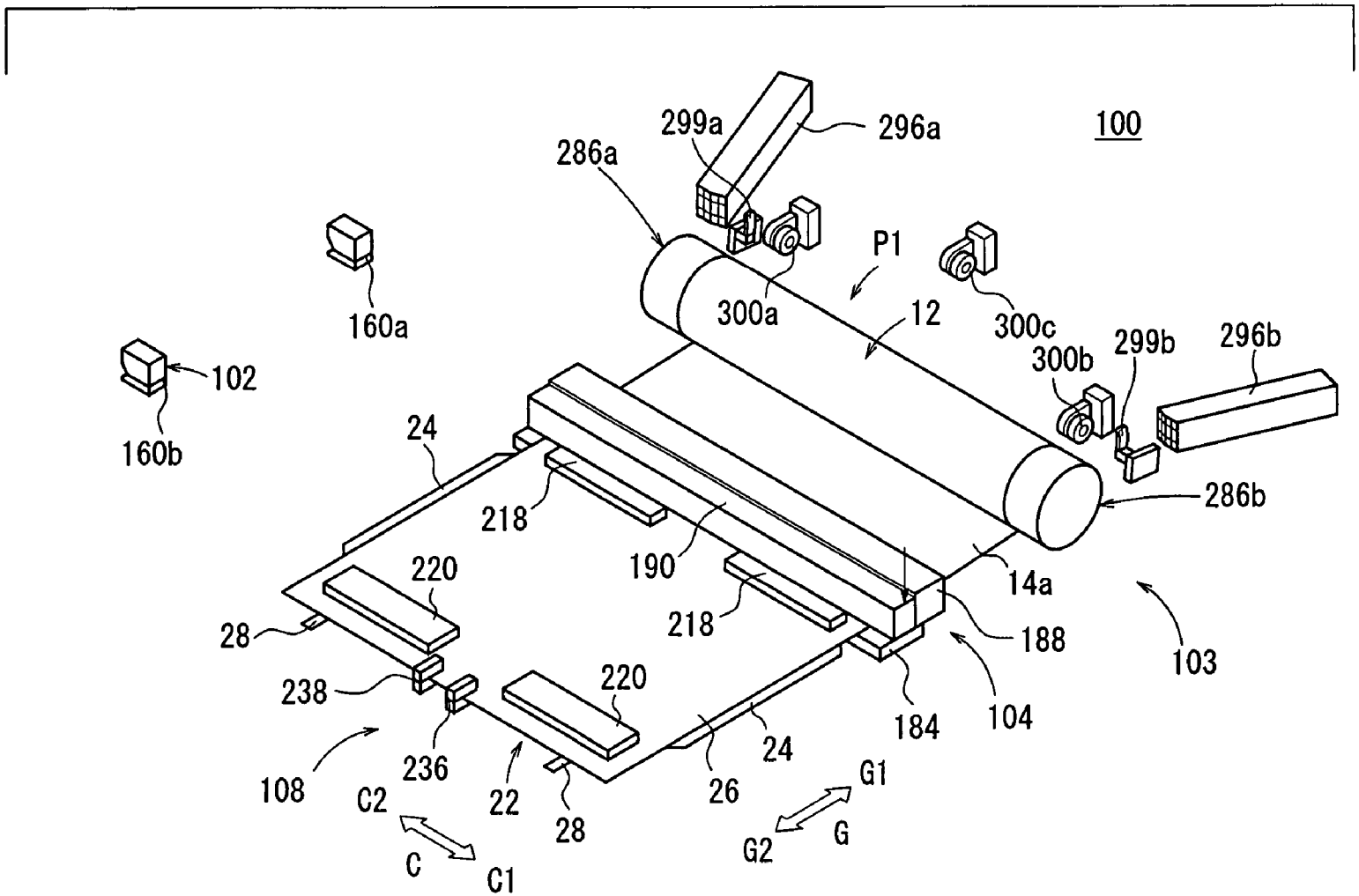
FIG. 17 is a perspective view of the packaging apparatus, illustrating the manner in which the attaching mechanism operates in another mode.

The lifting cylinder 186 is actuated to lower the rod 186*a* and the attachment plate 208 connected thereto. First, the first presser member 188 presses the end 14*a* of the photosensitive roll 12 against the movable bearing base 184. Then, the cylinder 214 is actuated to cause the second presser member 190 to attach the joint tape 20 to the end of the light-shielding leader 22 (see FIG. 17). The end 14*a* of the photosensitive roll 12 and the light-shielding leader 22 as they are reliably positioned are joined to the joint tape 20. Therefore, the light-shielding leader 22 is attached to the end 14*a* of the photosensitive roll 12 with accuracy.

Figure 18:
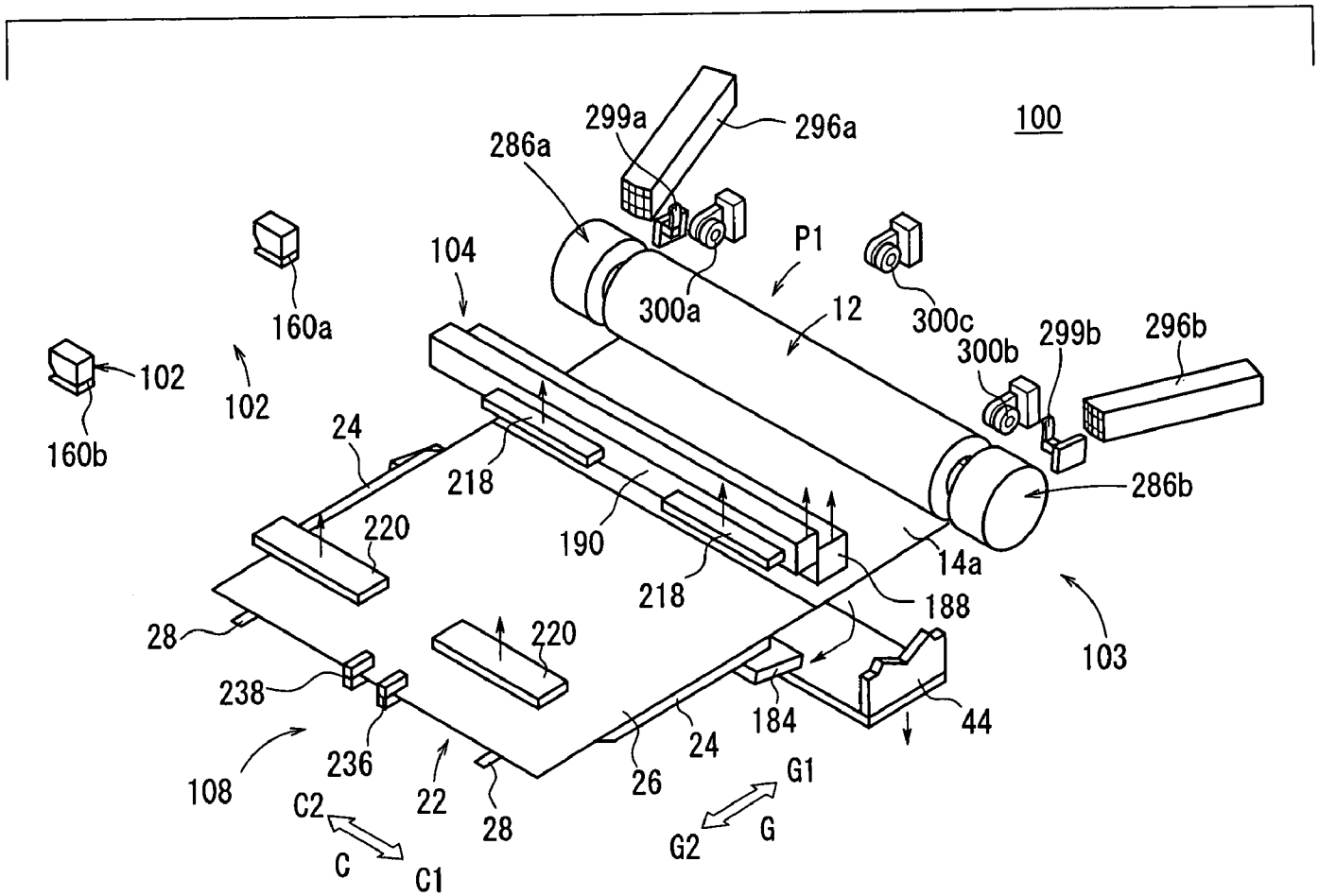
FIG. 18 is a perspective view of the packaging apparatus, illustrating the manner in which the light-shielding leader holding mechanism operates.

The lifting cylinder 186 is actuated to move the first and second presser members 188, 190 upwardly, and the cylinders 222, 224 are actuated to lift the light-shielding leader pressers 218, 220, releasing the light-shielding leader 22. At the same time, the first and second slide units 286*a,* 286*b* are moved away from each other and stopped in a position where the end face members 291*c* of the first and second chucks 290*a,* 290*b* are spaced a predetermined distance from the opposite ends of the photosensitive roll 12 (see FIG. 18).

While the first and second chucks 290*a,* 290*b* are being inserted in the respective opposite ends of the core 16 of the photosensitive roll 12, a fluid under pressure is supplied from the pressure fluid source through the solenoid-operated valve or the like into the cylinder chambers 295*a.* The cam members 295*b* of the first and second chucks 290*a,* 290*b* are moved forward, opening or expanding the first and second radially expandable and contractible claws 289*a,* 289*b* into contact with the inner circumferential surface of the core 16 thereby to hold the photosensitive roll 12. The pallet 44 is lowered a predetermined distance away from the outer circumferential surface of the photosensitive roll 12.

After the photosensitive roll 12 is held by only the first and second chucks 290*a,* 290*b,* the motor 292 is energized to rotate the splined shaft 293 about its own axis. Therefore, the first and second chucks 290*a,* 290*b* which are operatively connected to the splined shaft 293 by the belt and pulley means 294*a,* 294*b* start to rotate.

Figure 19:
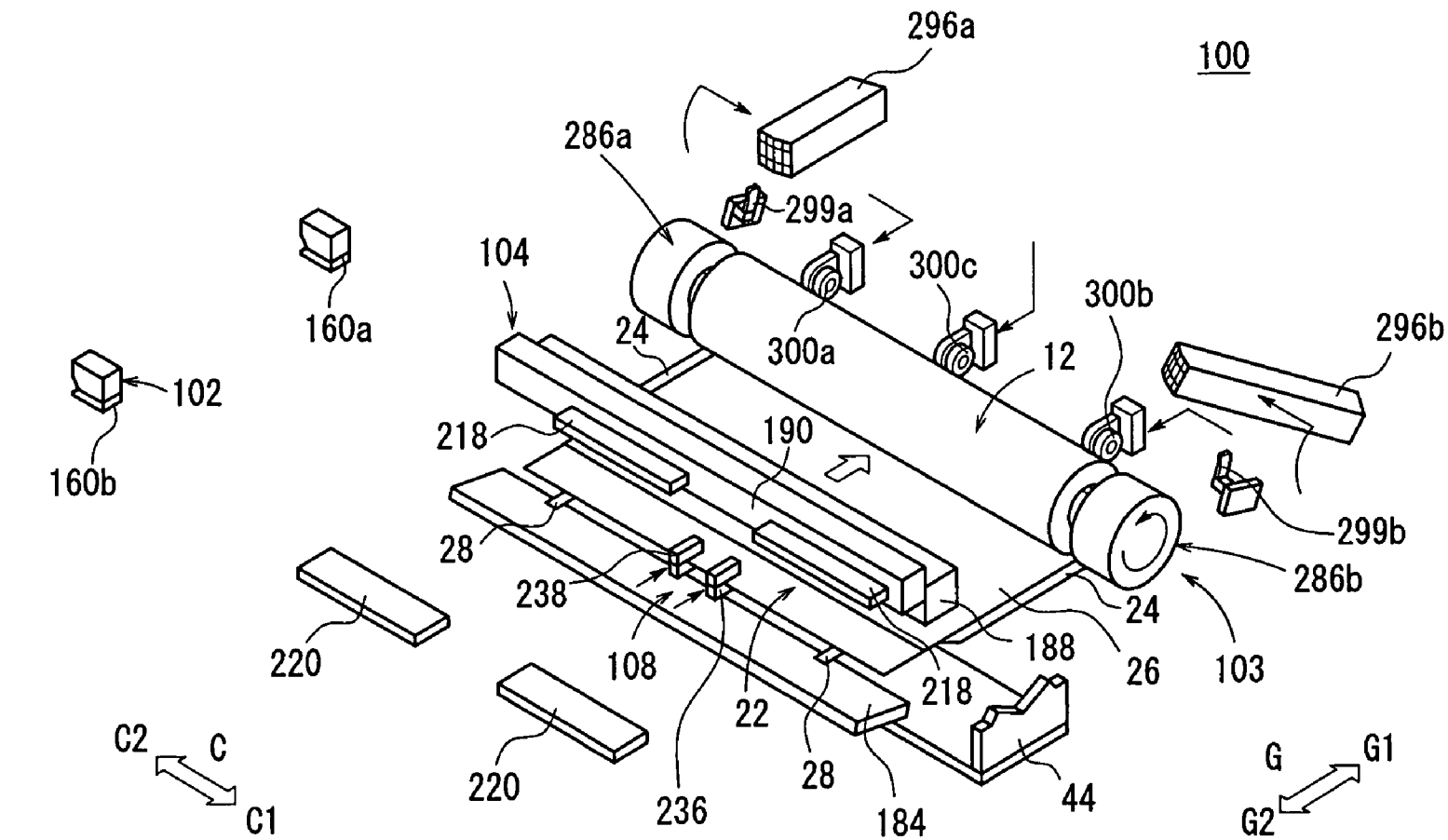
FIG. 19 is a perspective view of the packaging apparatus, illustrating the manner in which the light-shielding leader is wound.

In synchronism with the rotation of the first and second chucks 290*a,* 290*b,* the rodless cylinder 230 of the light-shielding leader holding mechanism 108 is actuated. The photosensitive roll 12 is rotated by the first and second chucks 290*a,* 290*b* to wind the light-shielding leader 22 therearound, and while the winding end of the light-shielding leader 22 is being gripped by the air chucks 236, 238 of the light-shielding leader holding mechanism 108, the air chucks 236, 238 are moved in the direction indicated by the arrow G1 (see FIG. 19). Consequently, the light-shielding leader 22 is reliably prevented from becoming twisted or turned with respect to the photosensitive roll 12, and hence wound turns of the light-shielding leader 22 around the photosensitive roll 12 are prevented from being positionally displaced. As a result, the light-shielding leader 22 can reliably be wound around the photosensitive roll 12 according to a simple process with a simple arrangement.

While the air chucks 236, 238 gripping the winding end of the light-shielding leader 22 is moving toward the winding terminal end in the direction indicated by the arrow G1, the cylinders 302*a,* 302*b* press the rollers 300*a,* 300*b,* 300*c* against the outer circumferential surface of the photosensitive roll 12. As shown in FIG. 13, the rollers 300*a,* 300*b* are caused to project forward by the cylinders 302*a,* 302*b*. The roller 300*c* is moved vertically downwardly by the first cylinder 306 of the actuator 304, and then is caused to project forward by the second cylinder 310. Thus, the rollers 300*a,* 300*b,* 300*c* press and hold the light-shielding leader 22 wound around the photosensitive roll 12.

Before the winding of the light-shielding leader 22 is finished, the air chucks 236, 238 release the light-shielding leader 22, and are retracted in the direction indicated by the arrow G2 by the rodless cylinder 230. Even after the air chucks 236, 238 have released the light-shielding leader 22, since the rollers 300*a,* 300*b,* 300*c* reliably hold the outer circumferential surface of the light-shielding leader 22, the light-shielding leader 22 can be wound highly reliably and accurately around the photosensitive roll 12.

In the process of winding the light-shielding leader 22 around the photosensitive roll 12, the hot air blowers 296*a,*

Figure 21:
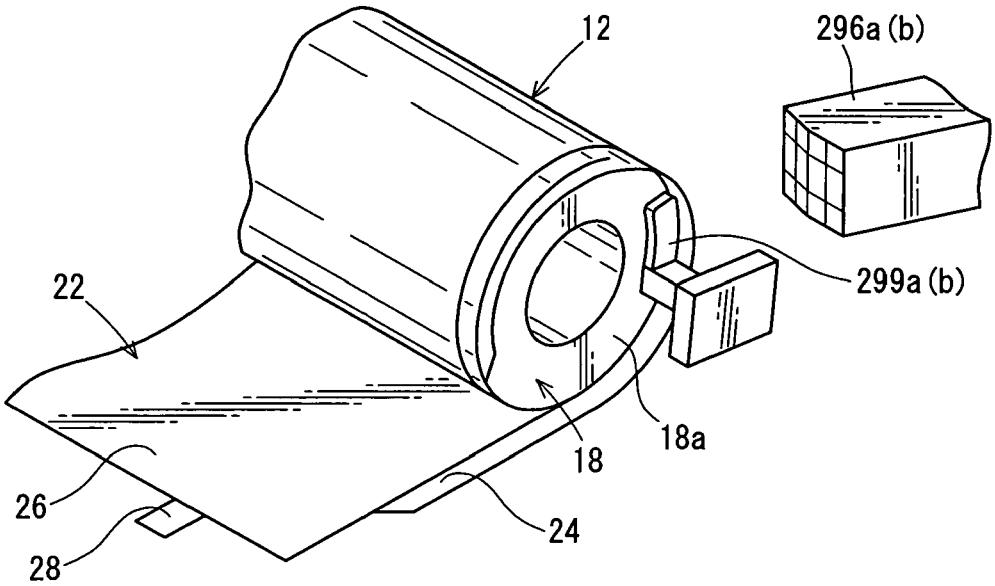
FIG. 21 is an enlarged fragmentary perspective view of the hot air blower and the presser.

296*b* and the pressers 299*a*, 299*b* of the pressing mechanism 110 that are mounted on the first and second slide units 286*a*, 286*b* by the support members 297*a*, 297*b* are placed in facing relation to the opposite ends of the photosensitive roll 12 by the cylinders 298*a*, 298*b* and the cylinders 301*a*, 301*b*. When the cylinders 303*a*, 303*b* are actuated, the pressers 299*a*, 299*b* press the outer circumferential edge portions 18*a* of the light-shielding members 18 against the opposite ends of the photosensitive roll 12 (see FIG. 21).

Figure 20:
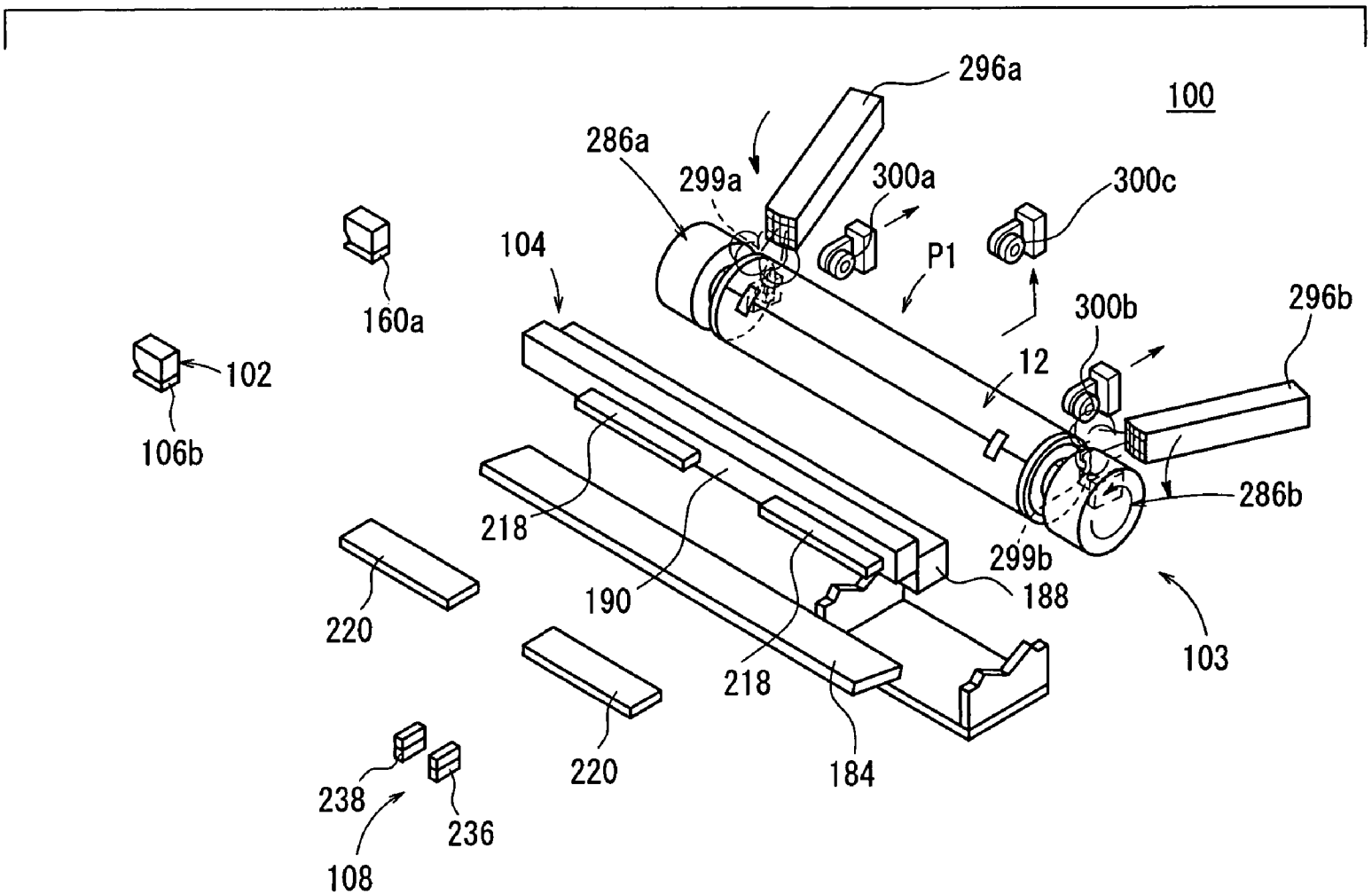
FIG. 20 is a perspective view of the packaging apparatus, illustrating the manner in which hot air blowers and pressers operate.

With the pressers 299*a*, 299*b* pressing the outer circumferential edge portions 18*a* of the light-shielding members 18 against the opposite ends of the photosensitive roll 12, the hot air blowers 296*a*, 296*b* apply hot air to the photosensitive roll 12, i.e., the light-shielding shrink films 24 of the light-shielding leader 22. The outer circumferential edge portions 18*a* of the light-shielding members 18 are thus prevented from floating off or being warped, and the light-shielding shrink films 24 are heat-shrunk while reliably covering the outer circumferential edge portions 18*a* of the light-shielding members 18 (see FIG. 20). If the photosensitive roll 12 is of a different type (e.g., a different diameter D), then the hot air blowers 296*a*, 296*b* and the pressers 299*a*, 299*b* may be positionally adjusted so as to be oriented toward the opposite ends of the photosensitive roll 12 of such a different type.

When the light-shielding leader 22 has been wound around the photosensitive roll 12 and the end of the light-shielding leader 22 has been fixed to the photosensitive roll 12 by the end fastening tapes 28, the process of winding the light-shielding leader 22 around the photosensitive roll 12 is finished. In this manner, the light-shielded photosensitive roll 30 is produced.

Then, the pallet lifting mechanism 240 is actuated to lift the vertically movable base 244 to hold the pallet 44. Then, the cylinder chambers 295*a* are connected to the negative pressure source by the solenoid-operated valve of the like. The cam members 295*b* of the first and second chucks 290*a*, 290*b* are now retracted by a negative pressure from the negative pressure source and the resiliency of springs (not shown) disposed in the cylinder chambers 295*a*, closing the first and second radially expandable and contractible claws 289*a*, 289*b*. The photosensitive roll 12, i.e., the light-shielded photosensitive roll 30, is now released from the first and second chucks 290*a*, 290*b*.

Then, the motor 264 of the rotating and supporting mechanism 103 is energized to move the first and second slide units 286*a*, 286*b* away from each other to displace the first and second chucks 290*a*, 290*b* off the opposite ends of the light-shielded photosensitive roll 30. The pallet 44 is lowered and transferred onto the feed conveyors 42*a*, 42*b*, and then fed, together with the light-shielded photosensitive roll 30, to a next process.

In the illustrated embodiment, the photosensitive roll 12 has been described as a rolled article by way of example. However, the present invention is not limited to the photosensitive roll 12, but is also applicable to any of various rolled articles including rolls of various strips such as a film, a sheet, etc.

Although a certain preferred embodiment of the present invention has been shown and described in detail, it should be understood that various changes and modifications may be made therein without departing from the scope of the appended claims.

What is claimed is:

1. A method of packaging a rolled article by winding a packaging sheet having skirt members on respective opposite side edges thereof around the rolled article which has a rolled elongate sheet with end packaging members having planar portions attached respectively to opposite sides of said rolled article, comprising the steps of:

gripping a side edge of said packaging sheet and feeding the packaging sheet to a winding position to position the packaging sheet in the winding position;

positioning said rolled article with respect to said packaging sheet in said winding position;

attaching an end of said packaging sheet to an end of said elongate sheet of said rolled article;

rotating said rolled article while gripping an opposite end of said packaging sheet to wind said packaging sheet around said rolled article; and mounting said skirt members on said planar portions of said end packaging members while rotating said article and while contacting parts of planar outer circumferential edge portions of said planar portions of the end packaging members by a pressing element to press said parts against respective opposite ends of said rotating article.

2. A method according to claim 1, further comprising the step of:

displacing the gripped opposite end of said packaging sheet toward said rolled article in synchronism with the rotation of said rolled article.

3. A method according to claim 1, further comprising the steps of:

pressing said packaging sheet against said rolled article by rollers, and after said packaging sheet is pressed against said rolled article by rollers, releasing the opposite end of said packaging sheet, and winding said packaging sheet around said rolled article.

4. An apparatus for packaging a rolled article by winding a packaging sheet having skirt members on respective opposite side edges thereof around the rolled article which has a rolled elongate sheet with end packaging members having planar portions attached respectively to opposite sides of said rolled article, comprising:

a packaging sheet feed mechanism for gripping a side edge of said packaging sheet and feeding the packaging sheet to a winding position to position the packaging sheet in the winding position;

a rotating and supporting mechanism for positioning said rolled article with respect to said packaging sheet in said winding position, and rotating said rolled article;

an attaching mechanism for attaching an end of said packaging sheet to an end of said elongate sheet of said rolled article;

a packaging sheet holding mechanism for gripping an opposite end of said packaging sheet and moving the packaging sheet toward said rolled article when said rolled article is rotated;

a pressing mechanism for pressing on the planar portions of the end packaging members against respective opposite ends of said rolled article; and a skirt installing mechanism for installing said skirt members on said planar portions of said end packaging members while said pressing mechanism presses on said end packaging members, wherein the skirt members are mounted on the planar portions of the end packaging members while the rolled article is rotated, and wherein the pressing mechanism contacts parts of planar outer circumferential edge portions of said planar portions of the end packaging members to press said parts against respective opposite ends of said rotating article.

5. An apparatus according to claim 4, wherein said packaging sheet feed mechanism comprises:

clamp means for gripping the side edge of said packaging sheet; and moving means for moving said clamp means to said winding position.

6. An apparatus according to claim 4, wherein said rotating and supporting mechanism comprises:

a pair of engaging means for engaging the opposite ends of said rolled article;

displacing means for moving said engaging means symmetrically toward and away from each other; and rotating means for rotating said rolled article through said engaging means.

7. An apparatus according to claim 6, wherein said pressing mechanism is displaceable in unison with said engaging means by said displacing means.

8. An apparatus according to claim 6, wherein said skirt installing mechanism is displaceable in unison with said engaging means by said displacing means.

9. An apparatus according to claim 4, wherein said attaching mechanism comprises:

positioning and holding means for positioning and holding the end of said elongate sheet; and pressing means for pressing the end of said packaging sheet against the end of said elongate sheet positioned and held by said positioning and holding means, with a joint means interposed therebetween.

10. An apparatus according to claim 4, further comprising:

rollers for pressing said packaging sheet against said rolled article.

11. An apparatus according to claim 4, wherein said skirt members are made of a shrink material which is shrinkable when heated, and said skirt installing mechanism comprises heating means for shrinking and installing said skirt members on said end packaging members.

* * * * *